US009588461B2

(12) United States Patent
Kamura et al.

(10) Patent No.: US 9,588,461 B2
(45) Date of Patent: Mar. 7, 2017

(54) DEVELOPER SUPPLY CONTAINER AND DEVELOPER SUPPLYING SYSTEM

(71) Applicant: CANON KABUSHIKI KAISHA, Tokyo (JP)

(72) Inventors: Akihito Kamura, Kashiwa (JP); Ayatomo Okino, Moriya (JP); Manabu Jimba, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/850,107

(22) Filed: Sep. 10, 2015

(65) Prior Publication Data

US 2015/0378278 A1 Dec. 31, 2015

Related U.S. Application Data

(63) Continuation of application No. PCT/JP2013/060411, filed on Mar. 29, 2013.

(30) Foreign Application Priority Data

Mar. 11, 2013 (JP) ..... 2013-047970

(51) Int. Cl.
*G03G 15/08* (2006.01)

(52) U.S. Cl.
CPC ..... *G03G 15/0867* (2013.01); *G03G 15/0872* (2013.01); *G03G 15/0877* (2013.01); *G03G 15/0886* (2013.01); *G03G 2215/0678* (2013.01)

(58) Field of Classification Search
USPC ..... 399/24–30, 107, 110, 119, 120, 252–263
See application file for complete search history.

(56) References Cited

U.S. PATENT DOCUMENTS 5,235,354 A 8/1993 Larson
5,446,478 A 8/1995 Larson
(Continued)

FOREIGN PATENT DOCUMENTS

JP H0-4143781 A 5/1992
JP H0-4505899 A 10/1992
(Continued)

OTHER PUBLICATIONS

International Search Report and Written Opinion in International Patent Application No. PCT/JP2013/060411.
(Continued)

*Primary Examiner* — Hoan Tran
(74) *Attorney, Agent, or Firm* — Fitzpatrick, Cella, Harper & Scinto

(57) ABSTRACT

A developer supply container is detachably mountable to a developer supplying apparatus and includes a pump portion provided to act at least on a developer discharging chamber. The pump portion has a volume changeable with expansion and contraction with reciprocation. A cam groove is provided for converting a rotational force received by a gear into a force for decreasing the volume of pump portion, a cam groove is provided for converting the received force into a force for increasing the volume of the pump portion, and a cam groove is provided for not converting the received force for operation of the pump portion. The supplying apparatus includes a phase detecting portion for stopping the rotation of a feeding portion of the developer supply container using one of the cam grooves.

36 Claims, 25 Drawing Sheets

A–A

(56) References Cited

U.S. PATENT DOCUMENTS

| | | | | |
|---|---|---|---|---|
| 7,050,728 | B2 | 5/2006 | Minagawa et al. | |
| 8,000,614 | B2 | 8/2011 | Okino et al. | |
| 8,565,649 | B2 | 10/2013 | Murakami et al. | |
| 2009/0169266 | A1 | 7/2009 | Uehara | |
| 2011/0020017 | A1* | 1/2011 | Takahashi ..... | G03G 15/0849 399/30 |
| 2012/0014713 | A1 | 1/2012 | Murakami et al. | |
| 2012/0014722 | A1 | 1/2012 | Okino et al. | |
| 2013/0209134 | A1 | 8/2013 | Okino et al. | |
| 2013/0209140 | A1* | 8/2013 | Murakami ..... | G03G 15/0875 399/258 |
| 2014/0016967 | A1 | 1/2014 | Murakami et al. | |
| 2014/0153974 | A1 | 6/2014 | Jimba et al. | |
| 2014/0169836 | A1 | 6/2014 | Nagashima et al. | |
| 2014/0233986 | A1 | 8/2014 | Murakami et al. | |
| 2015/0378278 | A1 | 12/2015 | Kamura et al. | |

FOREIGN PATENT DOCUMENTS

| | | | |
|---|---|---|---|
| JP | 5-232810 | * | 9/1993 |
| JP | H06-130812 | A | 5/1994 |
| JP | H06-250520 | A | 9/1994 |
| JP | 2009-128429 | A | 6/2009 |
| JP | 2009-175703 | A | 8/2009 |
| JP | 2010-0256893 | A | 11/2010 |
| TW | 1526796 | B | 9/2014 |
| WO | 2010/114153 | A | 10/2010 |
| WO | 2010/114154 | A | 10/2010 |
| WO | 2012/043875 | A1 | 4/2012 |
| WO | 2012/043876 | A1 | 4/2012 |
| WO | 2012/169657 | A1 | 12/2012 |
| WO | 2013/031996 | A1 | 3/2013 |

OTHER PUBLICATIONS

Office Action in Taiwanese Patent Application No. 104142614, dated Nov. 22, 2016.

* cited by examiner

A—A (a)

(b)

(c)

(a)

(b)

(a)

(b)

(a)

(b)

(c)

$\alpha = \beta$ $\alpha' = \beta'$ $\alpha' > \alpha$ $\beta' > \beta$ (a)

(b)

(a)

(b)

DEVELOPER SUPPLY CONTAINER AND DEVELOPER SUPPLYING SYSTEM

FIELD OF THE INVENTION

The present invention relates to a developer supply container detachably mountable to a developer replenishing apparatus and to a developer supplying system including them. The developer supply container and the developer supplying system are used with an image forming apparatus such as a copying machine, a facsimile machine, a printer or a complex machine having functions of a plurality of such machines.

BACKGROUND ART

Conventionally, an image forming apparatus such as an electrophotographic copying machine uses a developer of fine particles. In such an image forming apparatus, the developer is supplied from the developer supply container in response to consumption thereof resulting from image forming operation.

An example of such a developer supply container is disclosed in Japanese Laid-open Patent Application 2010-256893, which employs a drive converting mechanism for converting a rotational force inputted from the image forming apparatus to the developer supply container into a force for operating a displacement type pump portion. In the apparatus disclosed in Japanese Laid-open Patent Application 2010-256893, the pump portion is operated together with a feeding portion of the developer supply container to feed the developer accommodated in the developer supply container, and the developer can be discharged from the developer supply container by the volume change of the pump portion.

SUMMARY OF THE INVENTION

Problem to be Solved

Under the circumstances, the inventors have investigated a developer supply container in which the developer is discharged through a discharge opening by an inner volume change of the developer accommodating portion by converting the rotational force for feeding the developer into reciprocation of the pump portion.

However, when the developer supply container having such a structure is incorporated in the apparatus disclosed in Japanese Laid-open Patent Application 2010-256893, the pump portion may stop at a position halfway of the sucking operation or the discharging operation, because there is not provided a mechanism for controlling the stop position of the pump portion when the rotational force is stopped. In such a case, between the case in which the pump portion has stopped halfway of the sucking operation and the case in which the pump had stopped halfway of the discharging operation, the amount of the volume change caused by the subsequent reciprocation of the pump portion a different from each other, and therefore, the discharging property of the developer through the discharge opening may not be constant and unstable.

Accordingly, it is an object of the present invention to reduce the tendency of the difference in the amount of the volume change caused by the reciprocation of the pump portion which may result from different stop positions of the pump portion.

Means for Solving the Problem

The present invention provides a developer supply container detachably mountable to a developer supplying apparatus, said developer supply container comprising a developer accommodating portion for accommodating a developer; a rotatable drive receiving portion for receiving a rotational driving force; a feeding portion for feeding the developer in said developer accommodating portion by rotation of said drive receiving portion; a developer discharging chamber provided with a discharge opening for discharging the developer fed by said feeding portion; a pump portion provided to act at least on said developer discharging chamber and having a volume changeable with expansion and contraction with reciprocation; a drive converting portion for converting the rotational force received by said drive receiving portion into a force for operating said pump portion; and a portion-to-be-detected to be detected by a detecting portion provided in the developer supplying apparatus to stop said pump portion in a predetermined expansion and contraction state of said pump portion when operation of said pump portion is stopped.

The present invention provides a developer supplying system including a developer supplying apparatus and a developer supply container detachably mountable to said developer supplying apparatus, said developer supplying system wherein said developer supply container includes a developer accommodating portion for accommodating a developer; a rotatable drive receiving portion for receiving a rotational driving force; a feeding portion for feeding the developer in said developer accommodating portion by rotation of said drive receiving portion; a developer discharging chamber provided with a discharge opening for discharging the developer fed by said feeding portion; a pump portion provided to act at least on said developer discharging chamber and having a volume changeable with expansion and contraction with reciprocation; a drive converting portion for converting the rotational force received by said drive receiving portion into a force for operating said pump portion; and a portion-to-be-detected to be detected by a detecting portion provided in the developer supplying apparatus to stop said pump portion in a predetermined expansion and contraction state of said pump portion when operation of said pump portion is stopped, and said developer supplying apparatus includes a mounting portion for dismountably mounting said developer supply container; a developer receiving portion for receiving the developer through said discharge opening; a driving portion for applying a driving force to said drive receiving portion; a detecting portion for detecting said portion-to-be-detected and a controller for controlling the operation of said driving portion on the basis of a detection signal of said detecting portion.

Effects of the Invention

According to the present invention, the occurrence of the tendency of the difference in the amount of the volume change caused by the reciprocation of the pump portion which may result from different stop positions of the pump portion can be reduced.

Figure 2:
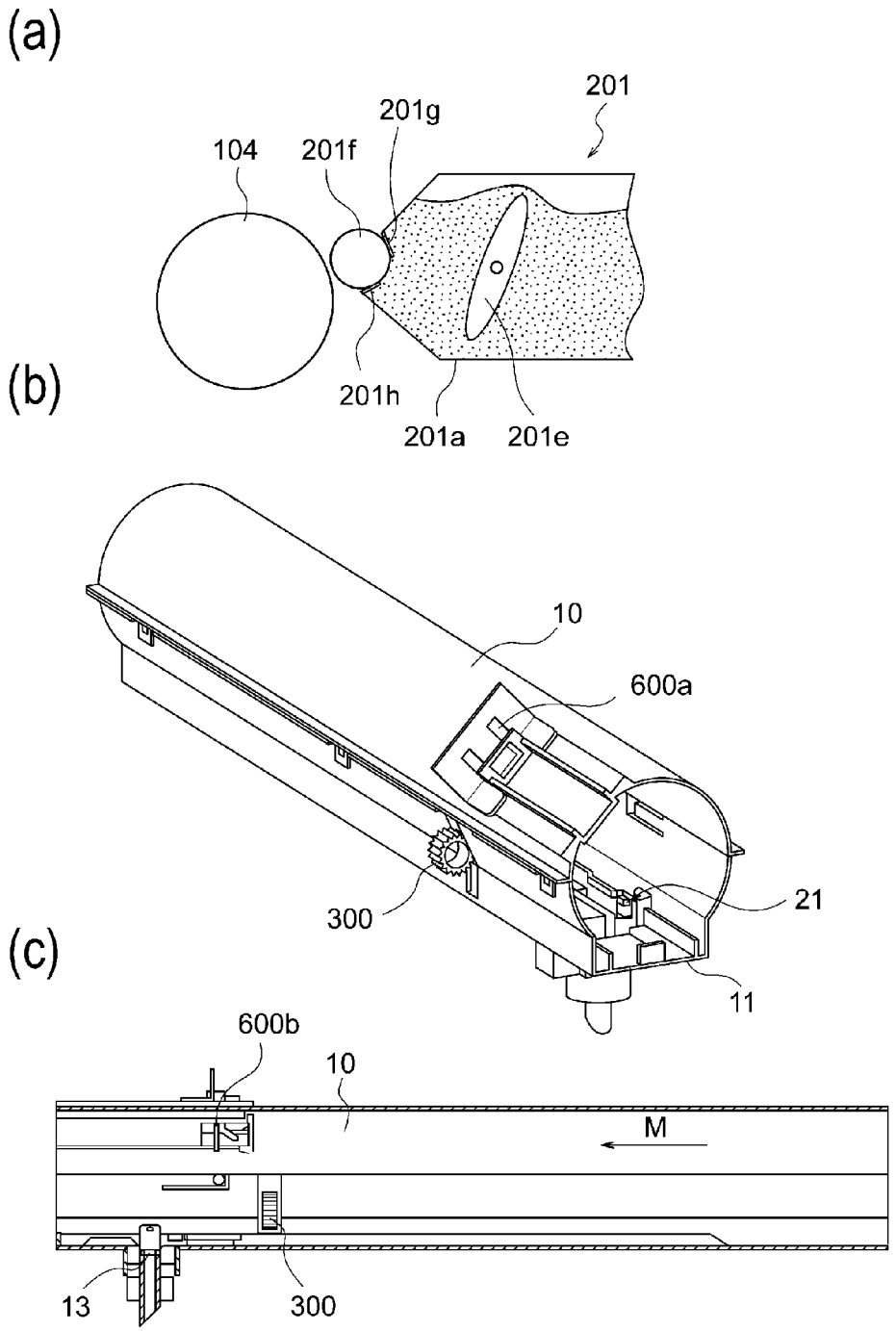

Part (a) of FIG. 2 is a partially sectional view of the developer supplying apparatus, (b) is a perspective view of a mounting portion, and (c) is a sectional view of the mounting portion.

Figure 3:
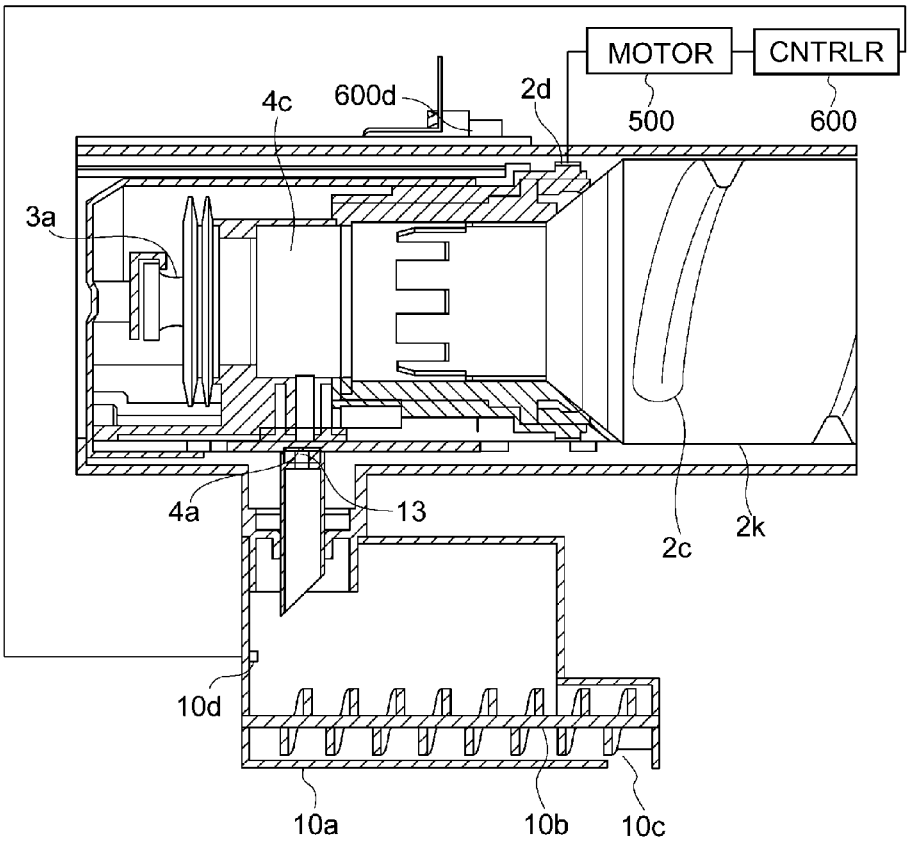

FIG. 3 is an enlarged sectional view illustrating a developer supply container and the developer replenishing apparatus.

Figure 4:
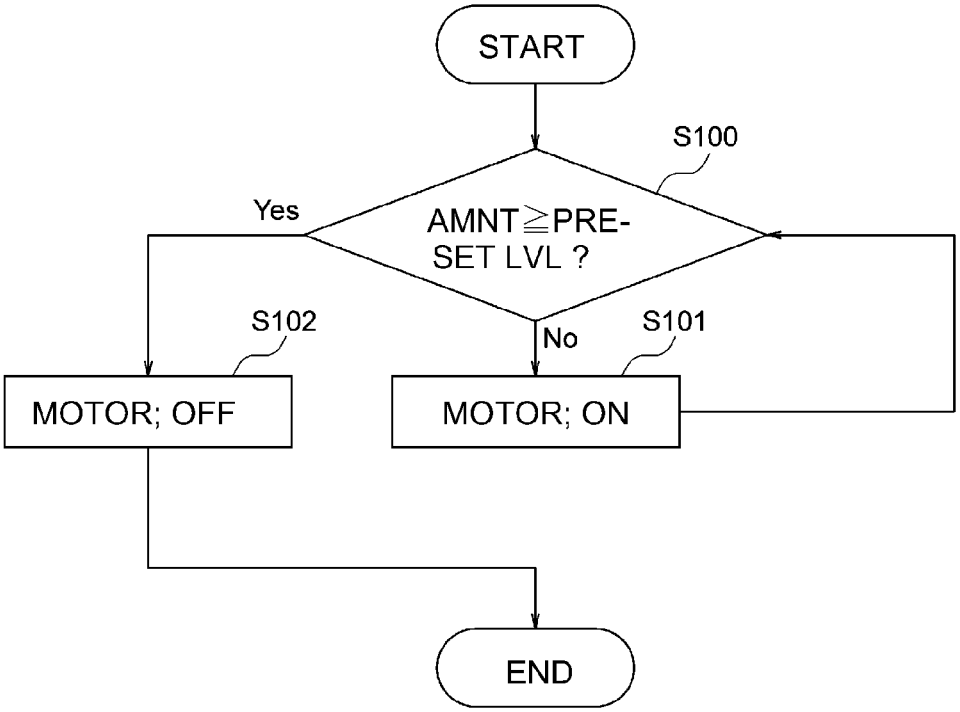

FIG. 4 is a flow chart illustrating a flow of a developer supply operation.

Figure 5:
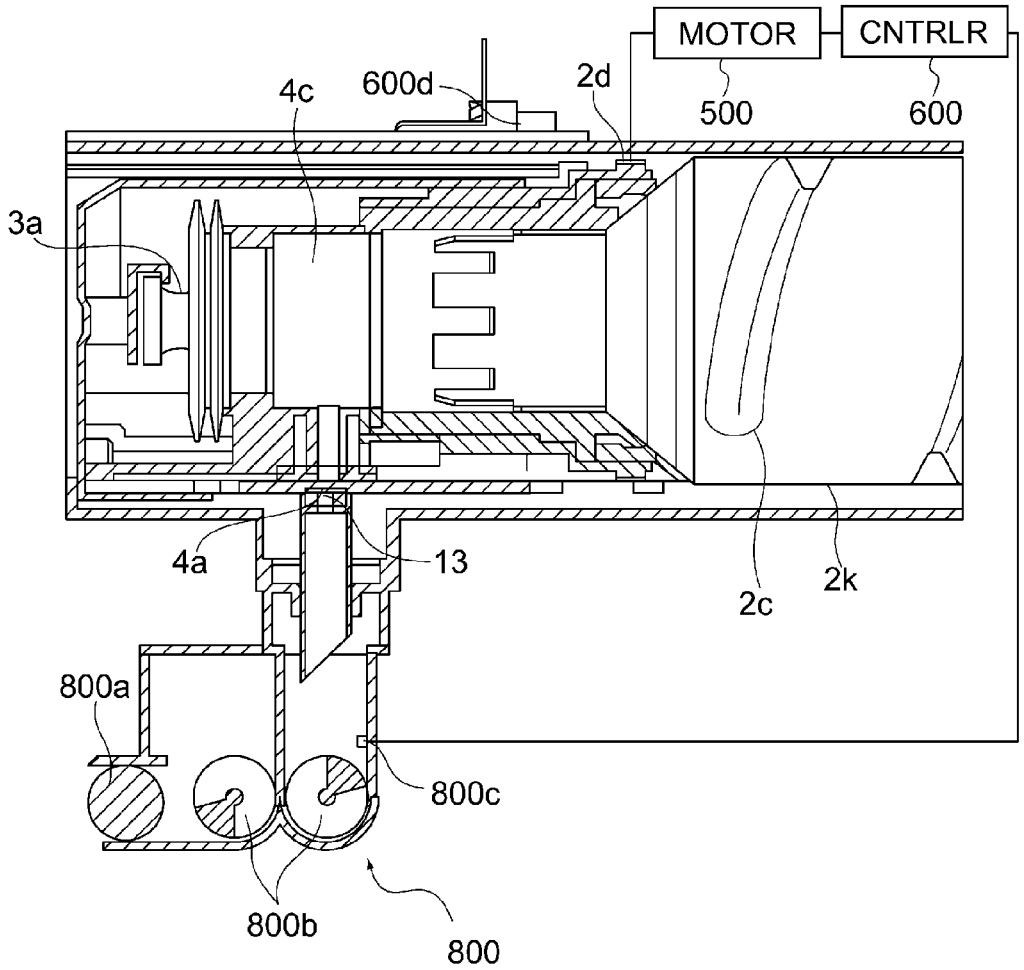

FIG. 5 is an enlarged sectional view of a modified example of the developer replenishing apparatus.

Figure 6:
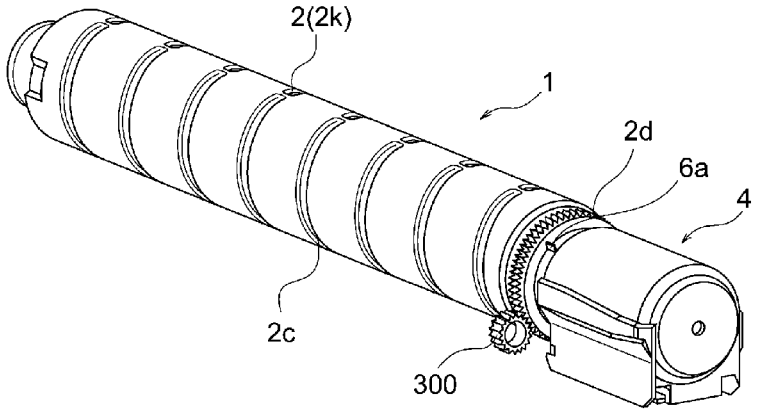
Figure 6:
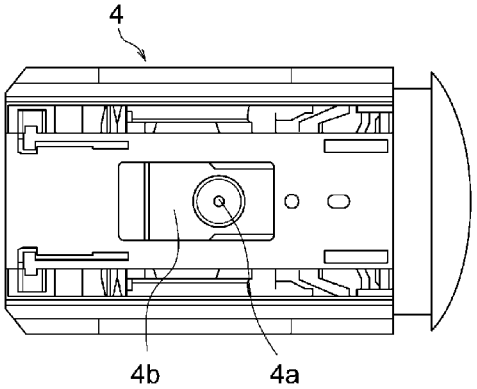
Figure 6:
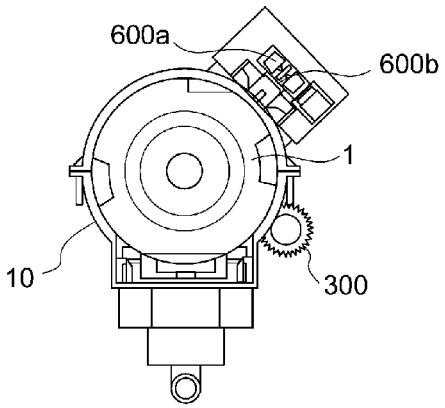

Part (a) of FIG. 6 is a perspective view illustrating the developer supply container according to Embodiment 1 of the present invention, (b) is a partial enlarged view illustrating a state around a discharge opening, and (c) is a front view illustrating a state in which the developer supply container is mounted to the mounting portion of the developer supplying apparatus.

Figure 7:
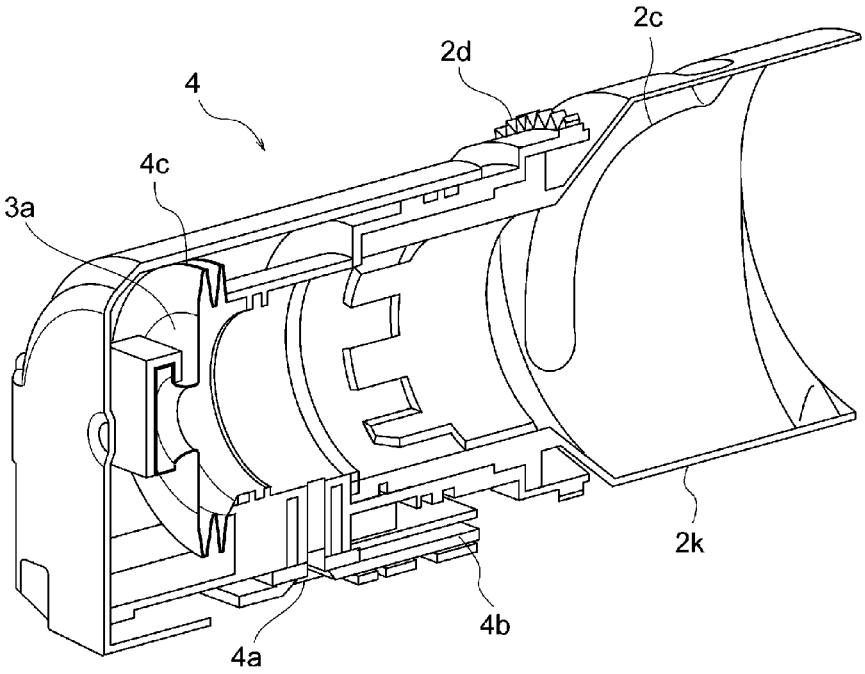

FIG. 7 is a perspective view of a section of the developer supply container.

Figure 8:
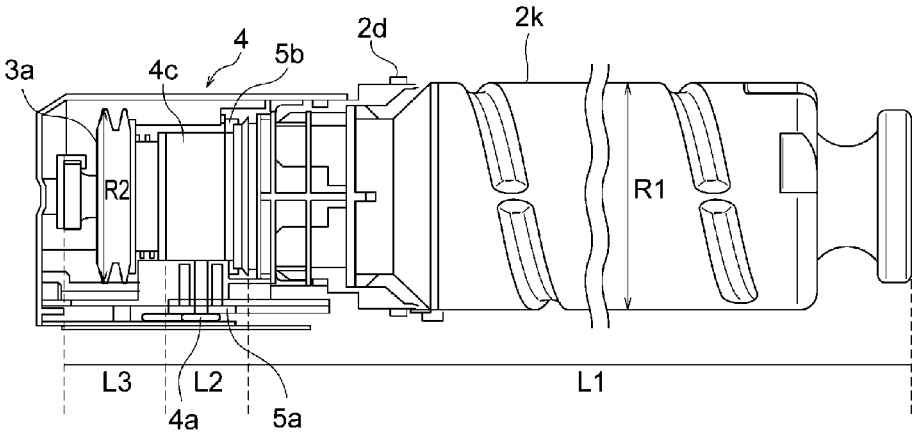
Figure 8:
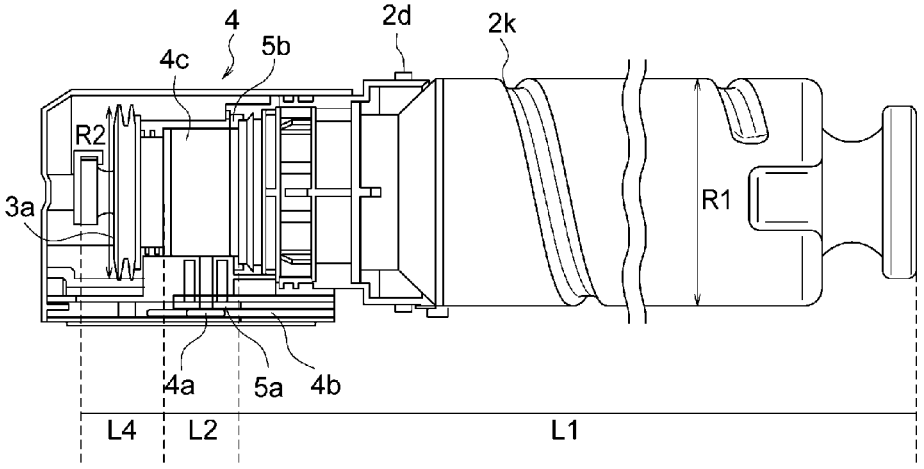

Part (a) of FIG. 8 is a partially sectional view in a state in which the pump portion is expanded to the maximum usable limit, and (b) is a partially sectional view in a state in which the pump portion is contracted to the maximum usable limit.

Figure 9:
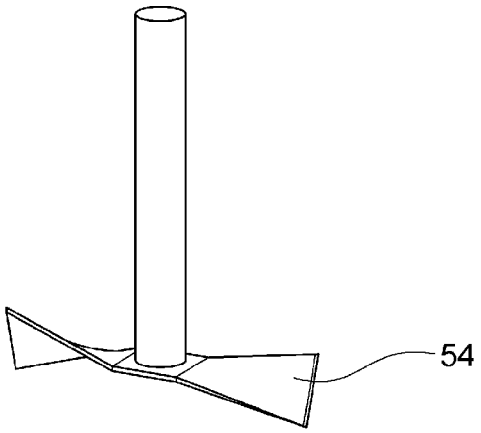
Figure 9:
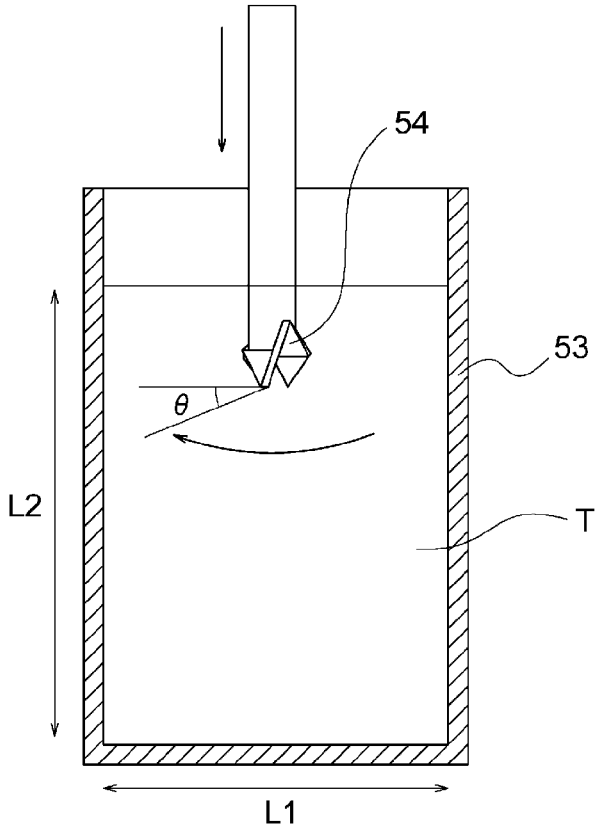

Part (a) of FIG. 9 is a perspective view of a blade used with a device for measuring fluidity energy, and (b) is a schematic view of the device.

Figure 10:
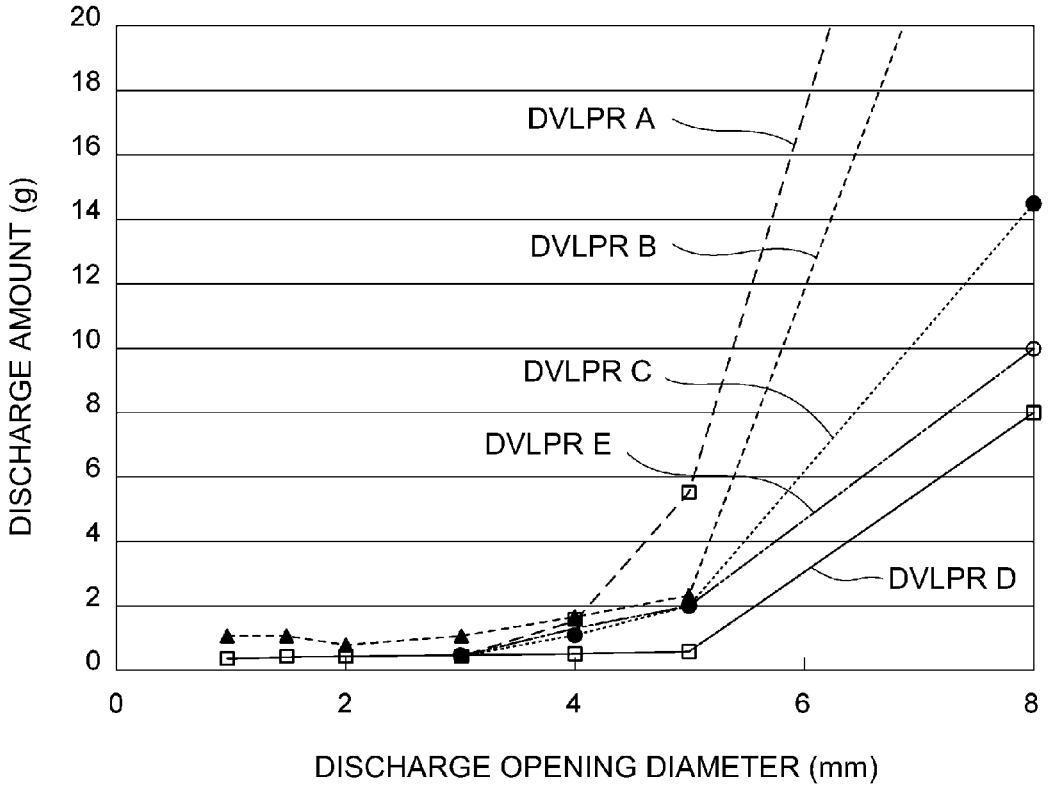

FIG. 10 is a graph showing a relation between a diameter of a discharge opening and a discharge amount.

Figure 11:
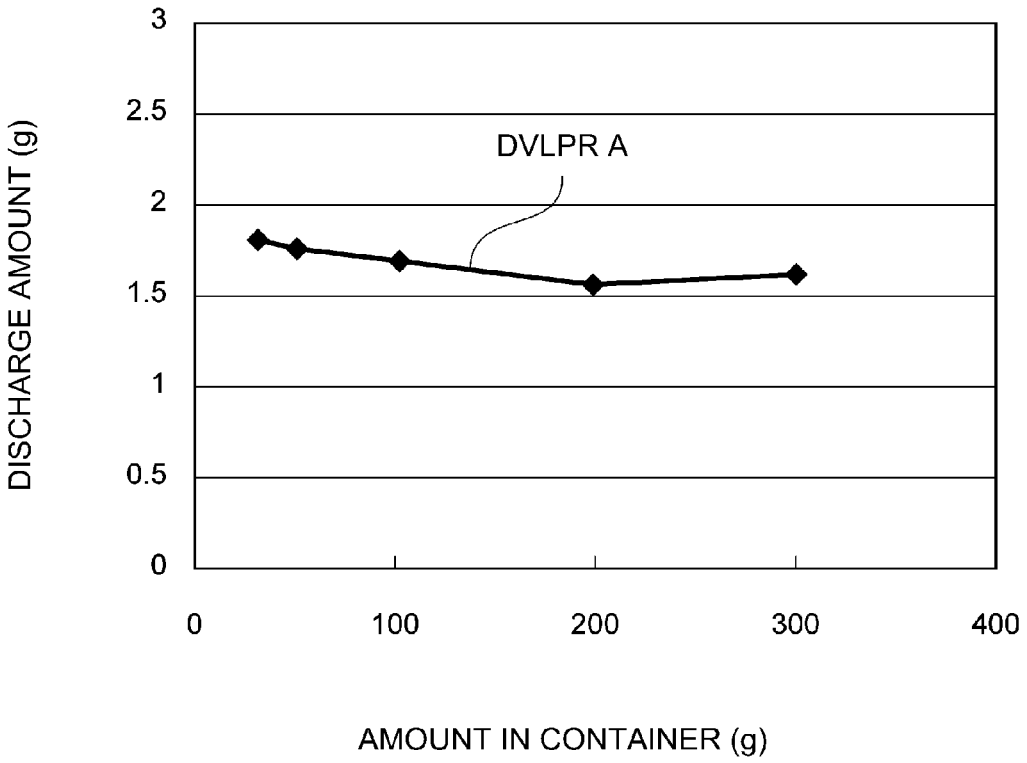

FIG. 11 is a graph showing a relation between an amount in the container and a discharge amount.

Figure 12:
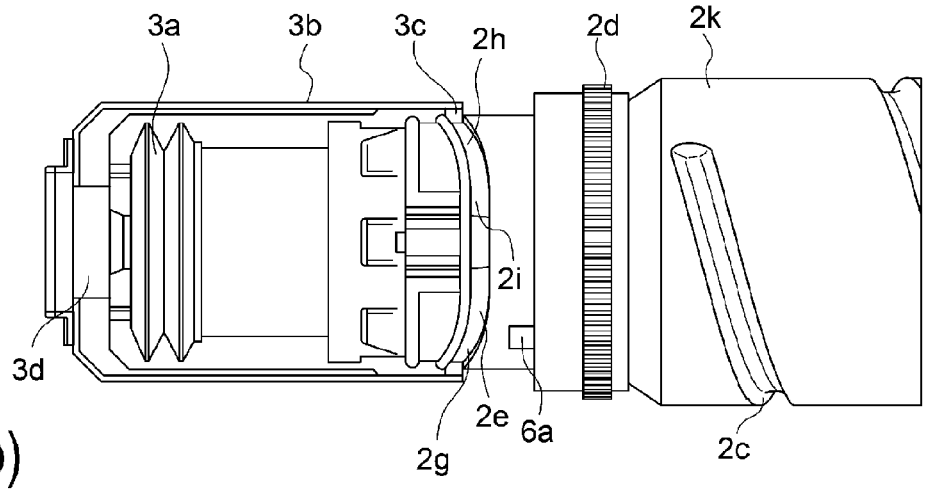
Figure 12:
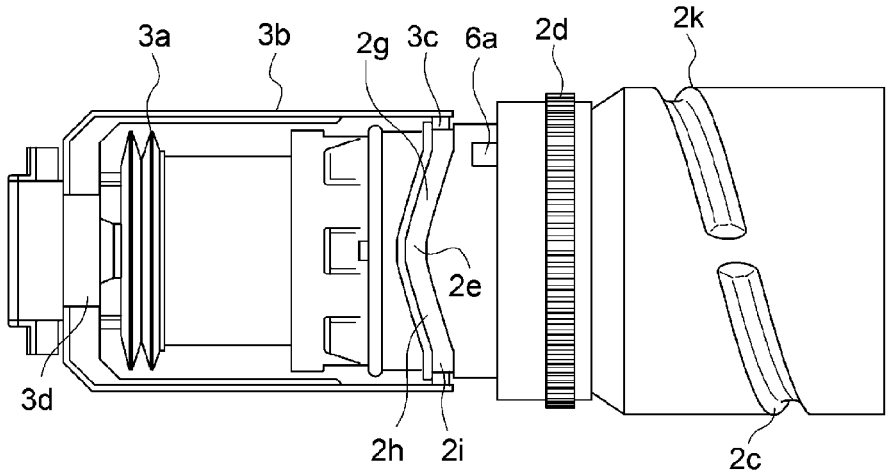
Figure 12:
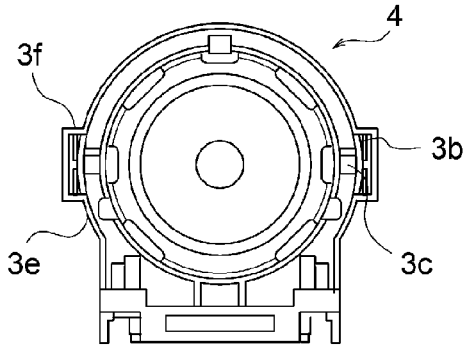

Part (a) of FIG. 12 is a partial view in a state in which the pump portion is expanded to the maximum usable limit, (b) is a partial view in a state in which the pump portion is contracted to the maximum usable limit, and (c) is a partial view of the pump portion.

Figure 13:
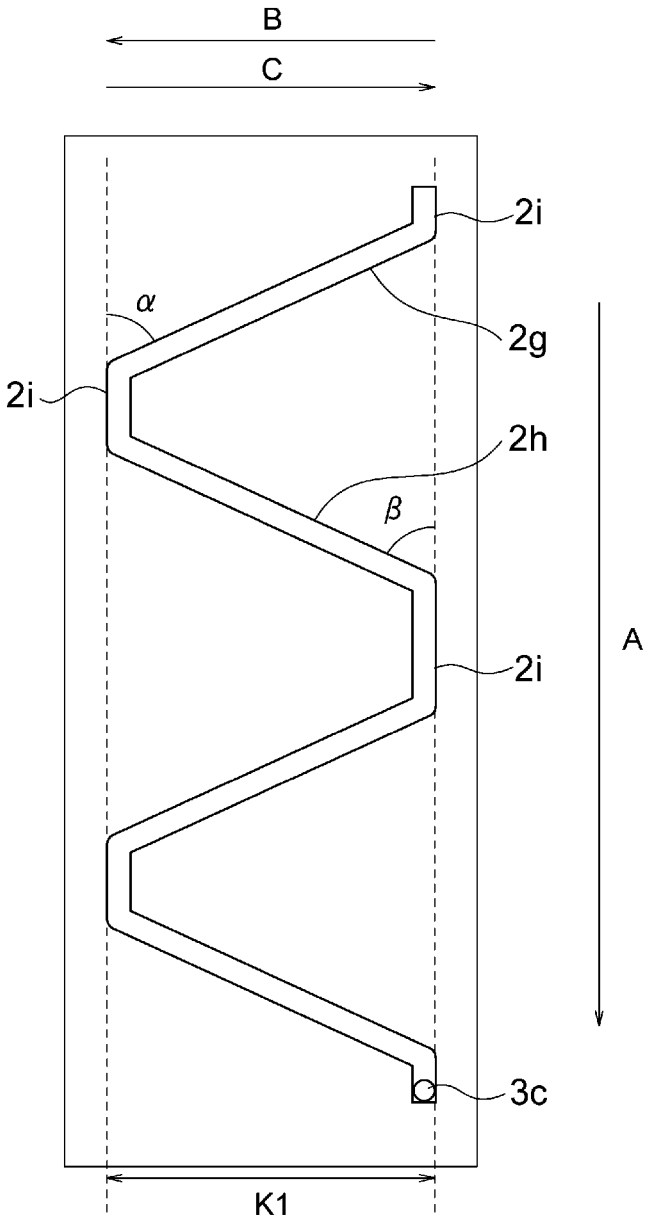

FIG. 13 is an extended elevation illustrating a cam groove configuration of the developer supply container.

Figure 14:
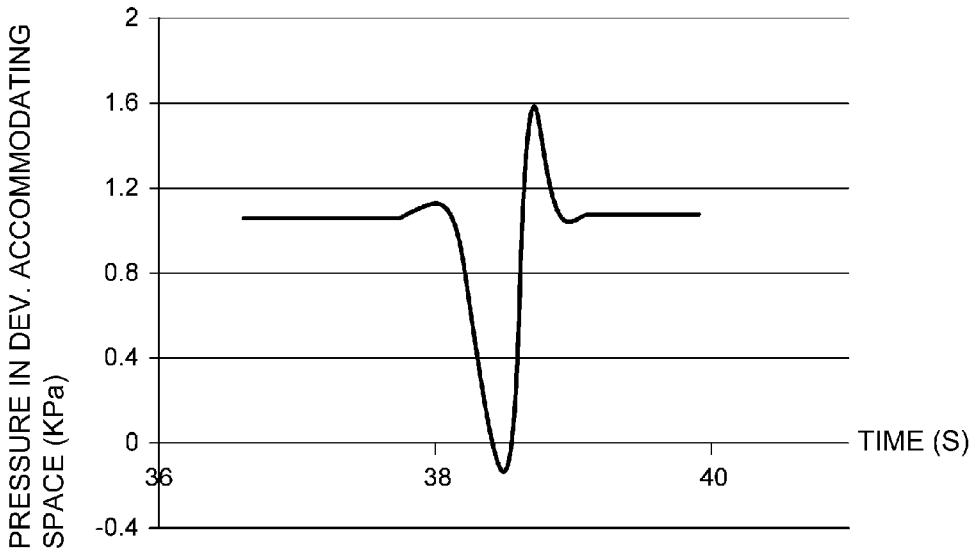

FIG. 14 illustrates a change of an internal pressure of the developer supply container.

Figure 15:
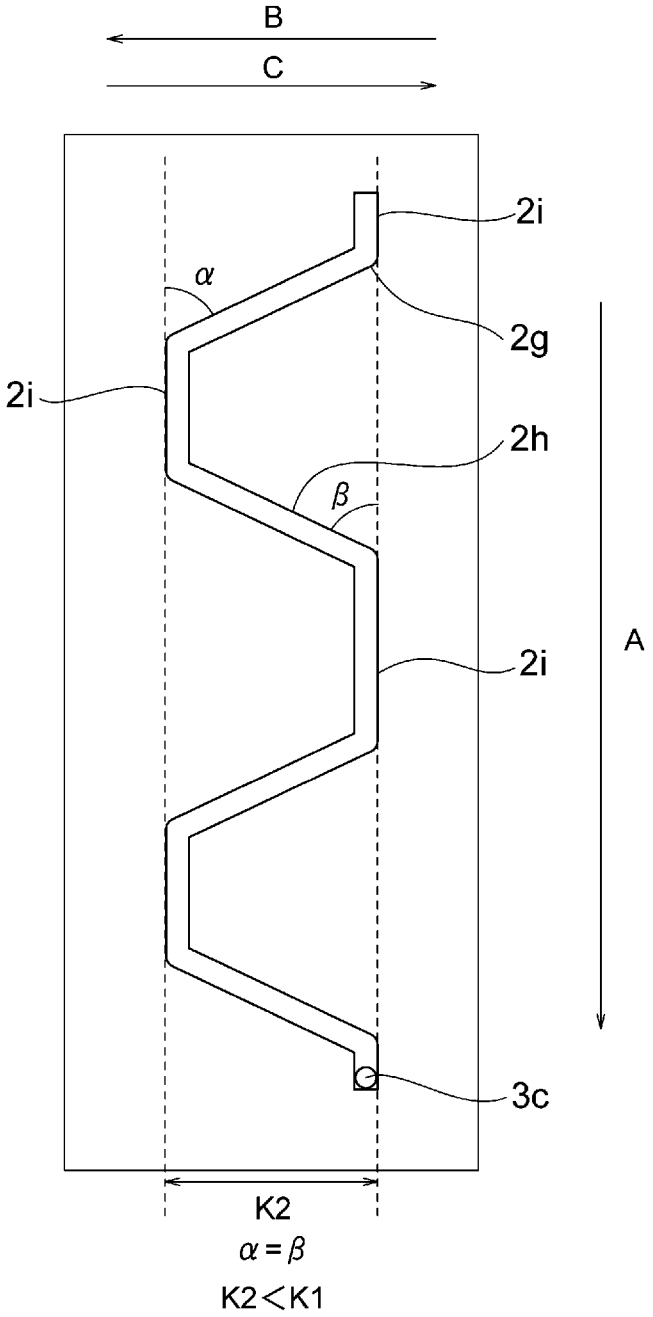

FIG. 15 is an extended elevation of an example of the cam groove configuration of the developer supply container.

Figure 16:
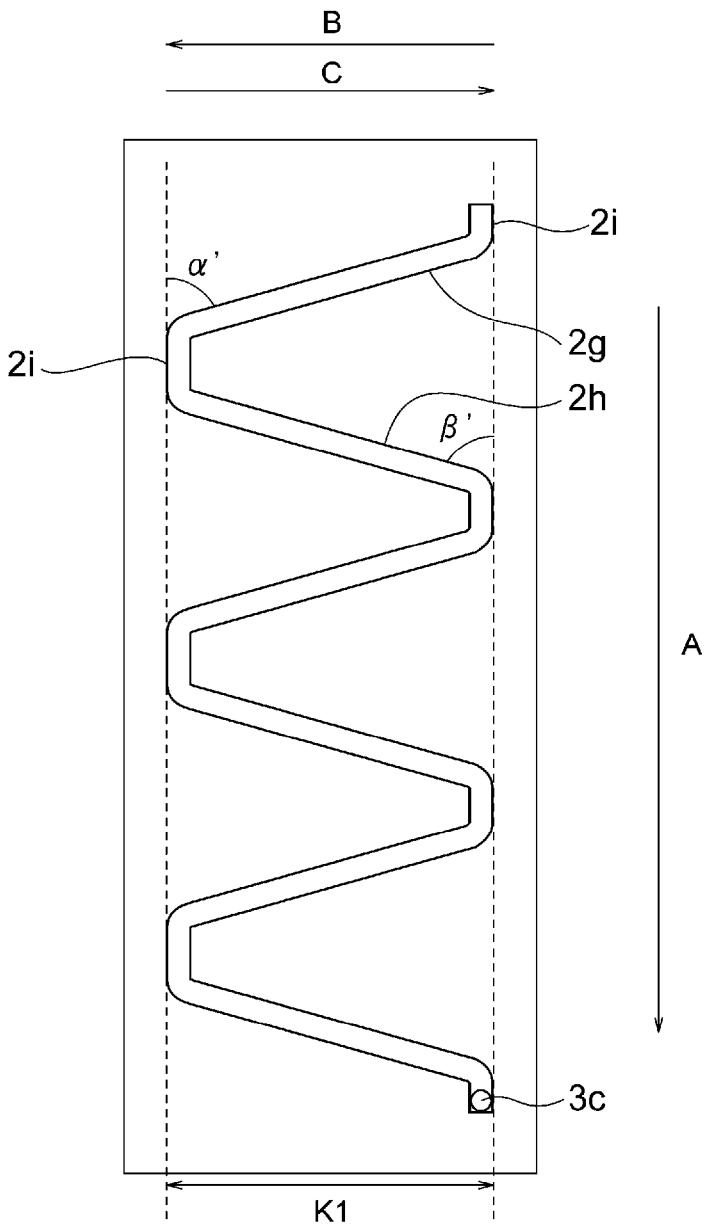

FIG. 16 is an extended elevation of an example of the cam groove configuration of the developer supply container.

Figure 17:
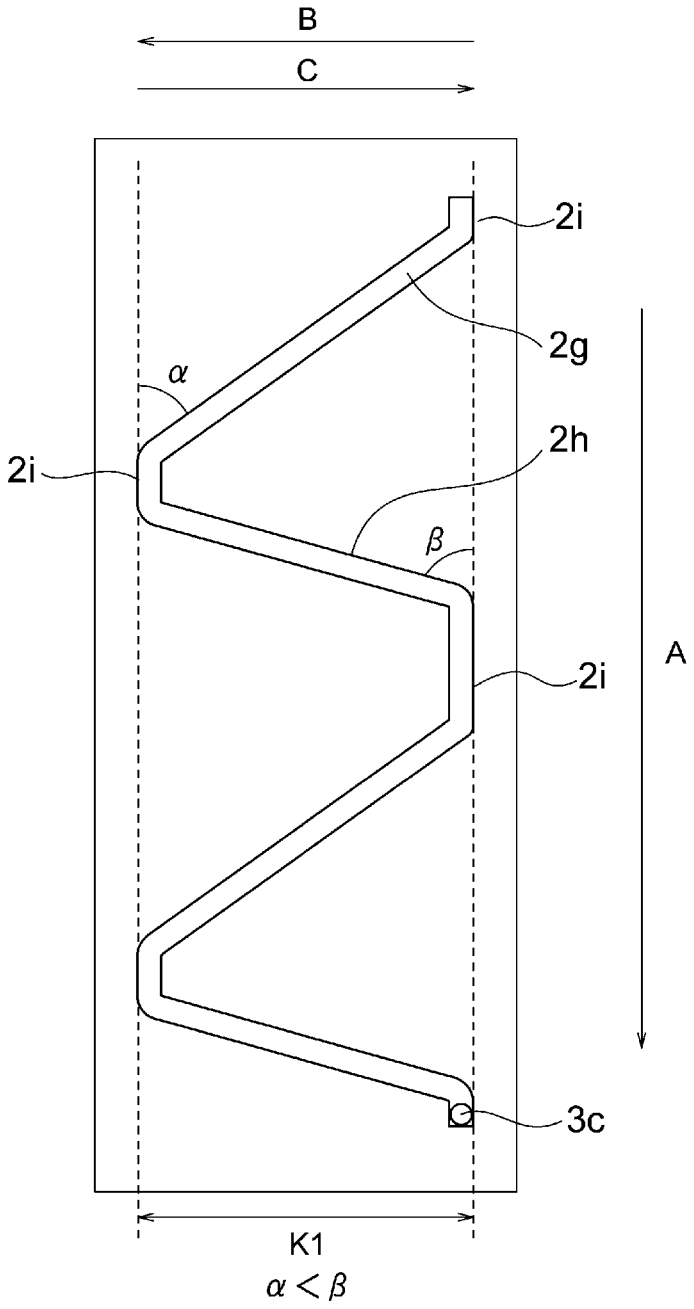

FIG. 17 is an extended elevation of an example of the cam groove configuration of the developer supply container.

Figure 18:
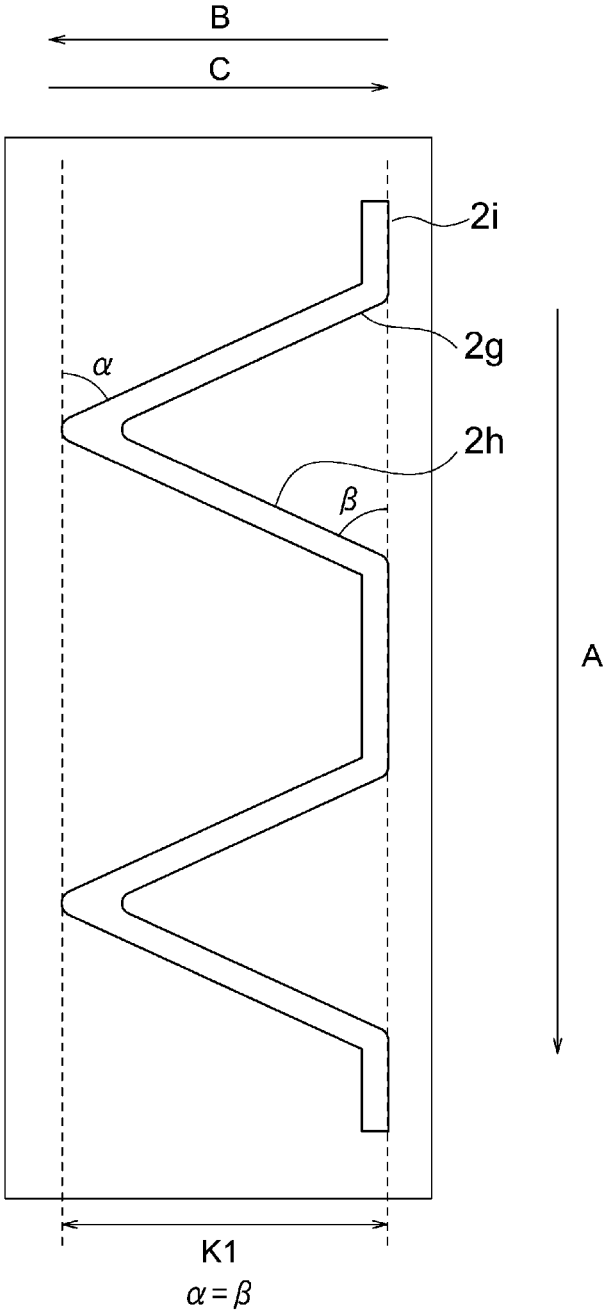

FIG. 18 is an extended elevation of an example of the cam groove configuration of the developer supply container.

Figure 19:
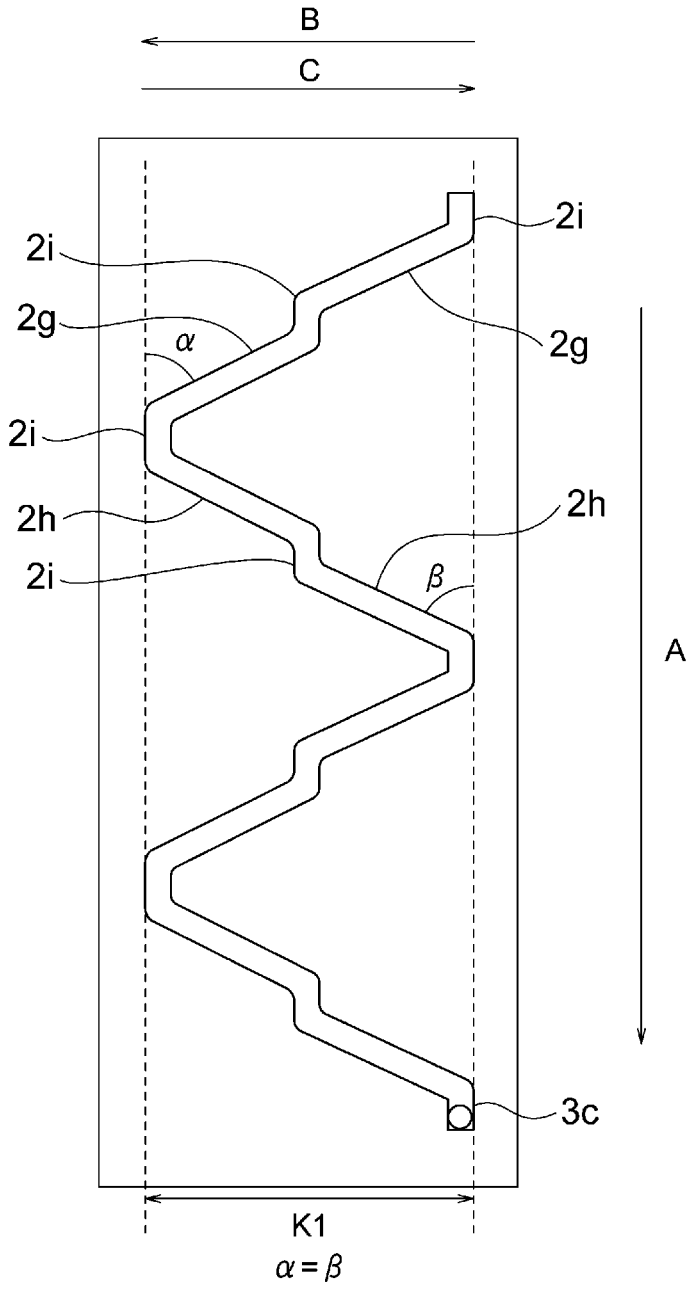

FIG. 19 is an extended elevation of an example of the cam groove configuration of the developer supply container.

Figure 20:
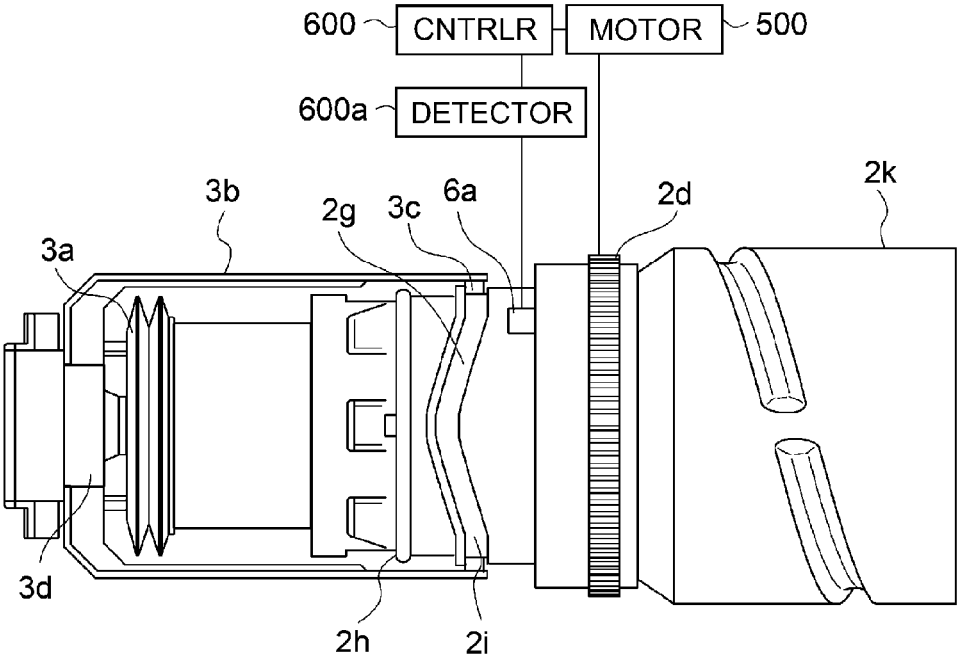

FIG. 20 is an enlarged sectional view illustrating a developer supply container and the developer replenishing apparatus.

Figure 21:
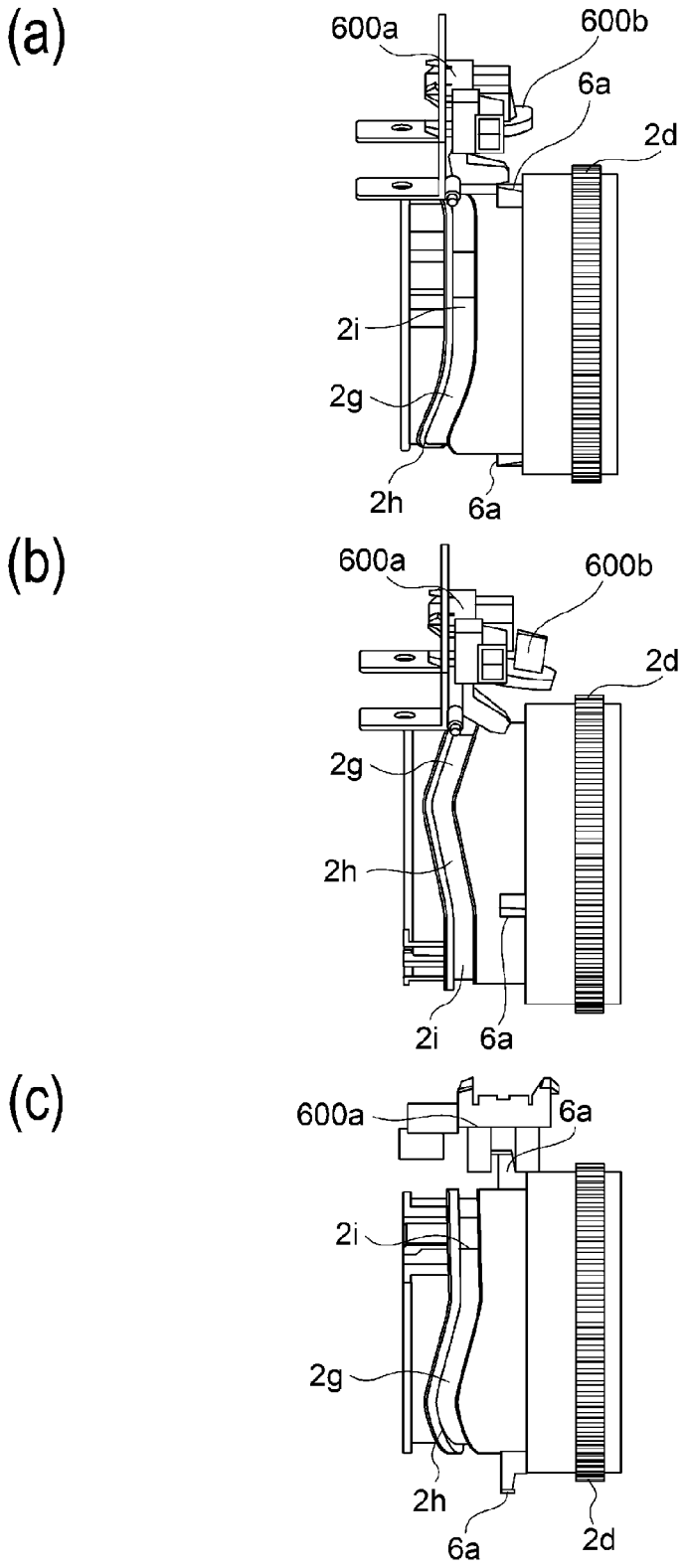

Part (a) of FIG. 21 is a partial enlarged view illustrating a phase detecting portion position during the rotation of a driving motor, (b) is a partial enlarged view of the phase detecting portion position when the driving motor is at rest, and (c) is a partial enlarged view of an example of the phase detecting portion position when the driving motor is at rest.

Figure 22:
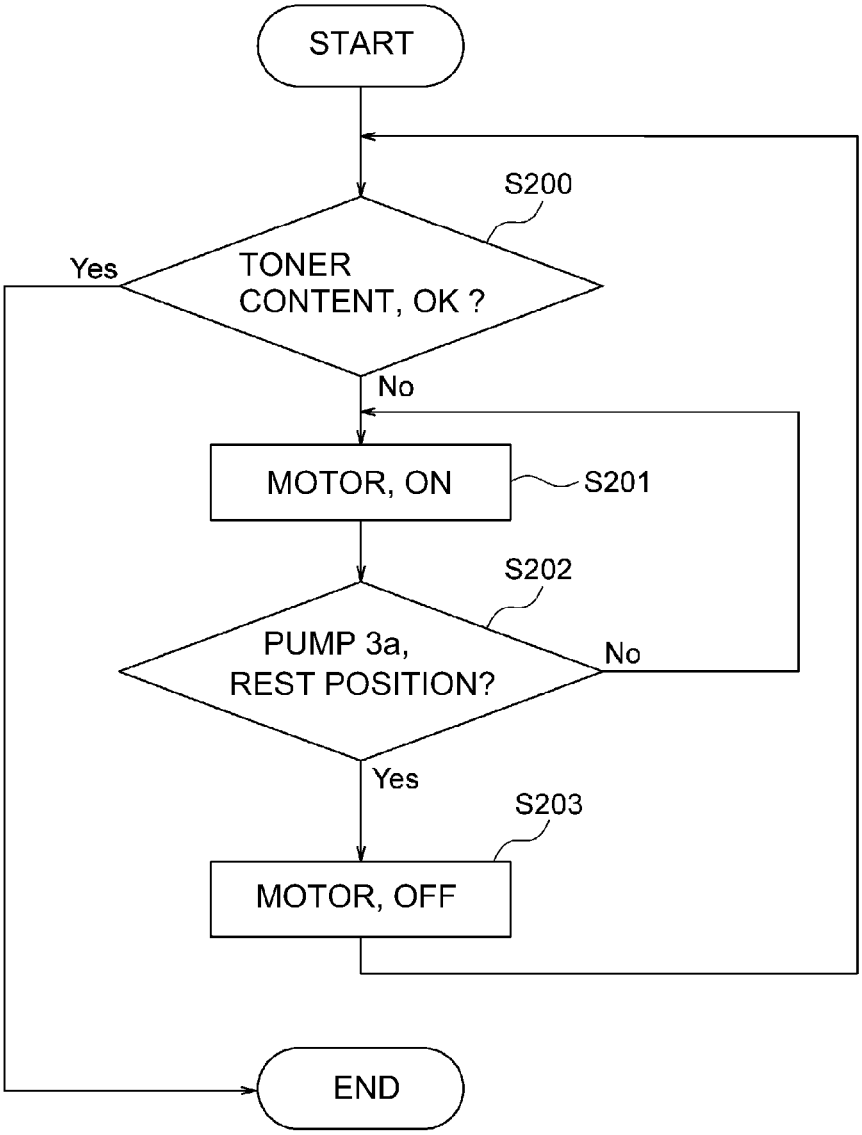

FIG. 22 is a flow chart illustrating a flow of the rotation control.

Figure 23:
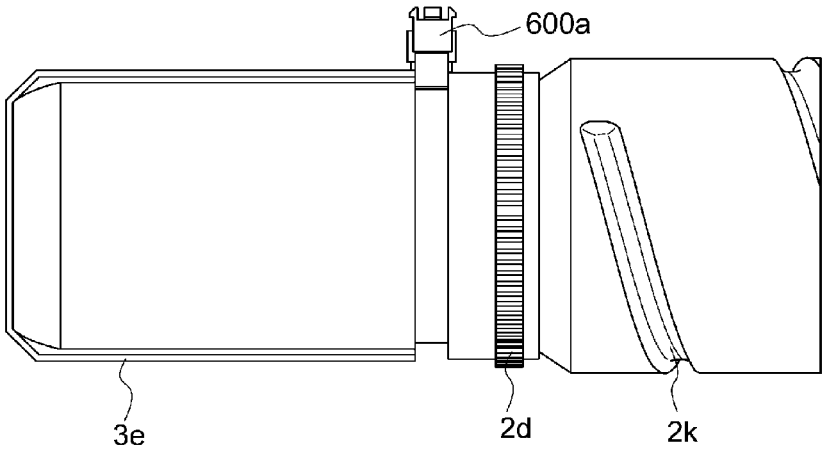
Figure 23:
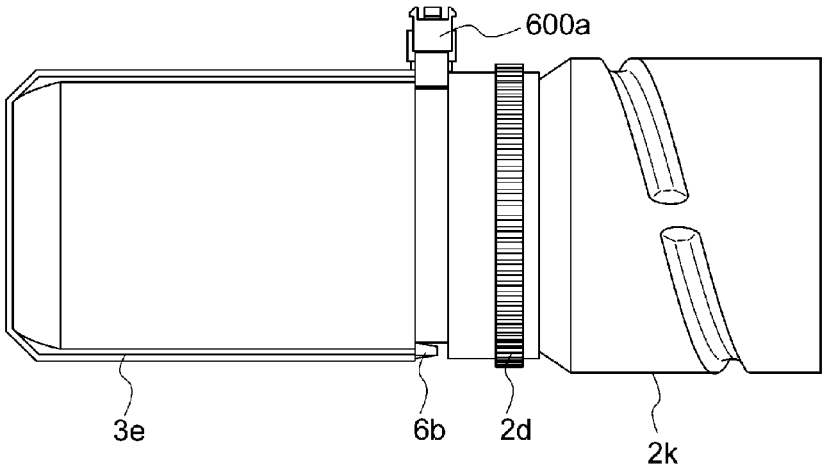

Part (a) of FIG. 23 is a partial view in a state in which the pump portion according to Embodiment 2 is expanded to the maximum usable limit, and (b) is a partial view in a state in which the pump portion is contracted to the maximum usable limit.

Figure 24:
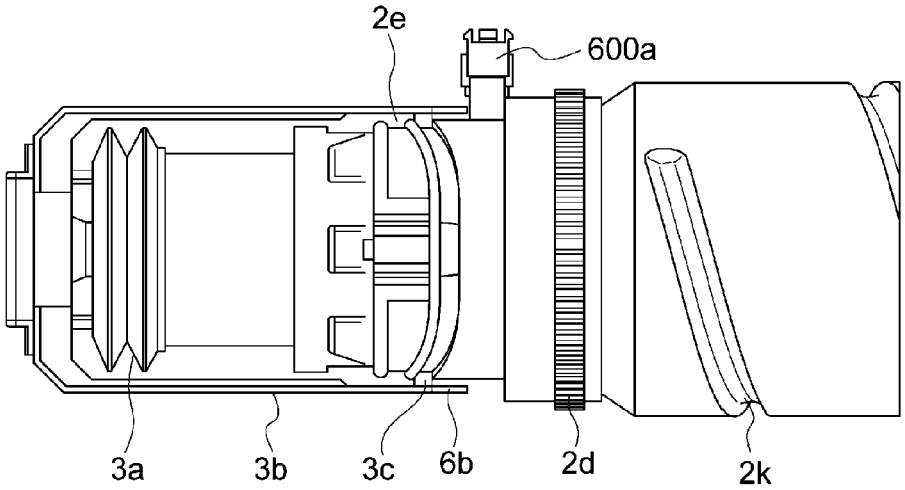
Figure 24:
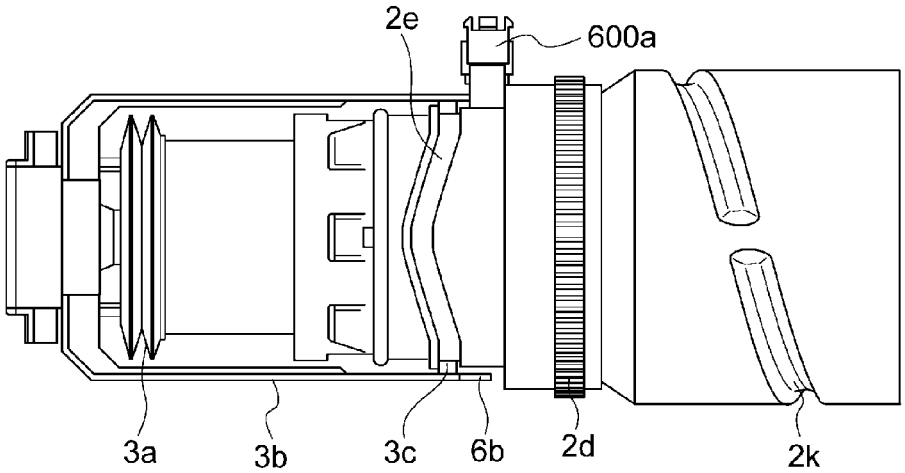

Part (a) of FIG. 24 is a partial view in a state in which the pump portion is expanded to the maximum usable limit, and (b) is a partial view in a state in which the pump portion is contracted to the maximum inducible limit.

Figure 25:
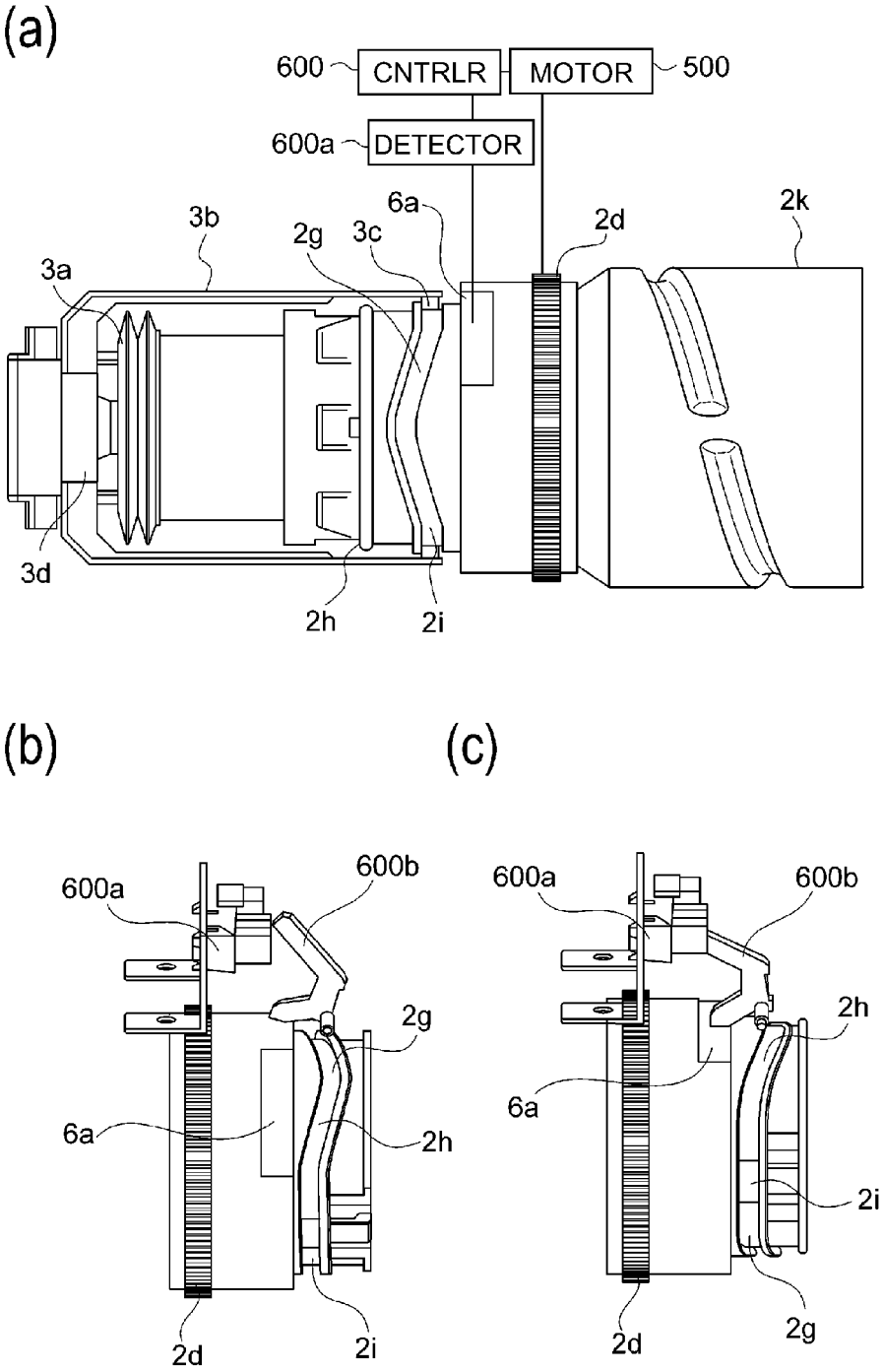

Part (a) of FIG. 25 is an enlarged sectional view of the developer supply container and the developer supplying apparatus, (b) is a partial enlarged view of the phase detecting portion position during the rotation of the driving motor, and (c) is a partial enlarged view of the phase detecting portion position when the driving motor is at rest.

DESCRIPTION OF THE EMBODIMENTS

In the following, the description will be made as to a developer supply container and a developer supplying system according to the present invention in detail. In the following description, various structures of the developer supply container may be replaced with other known structures having similar functions within the scope of the concept of invention unless otherwise stated. In other words, the present invention is not limited to the specific structures of the embodiments which will be described hereinafter, unless otherwise stated.

Embodiment 1

First, basic structures of an image forming apparatus will be described, and then, a developer supplying system, that is, a developer replenishing apparatus and a developer supply container used in the image forming apparatus will be described.

(Image Forming Apparatus)

Figure 1:
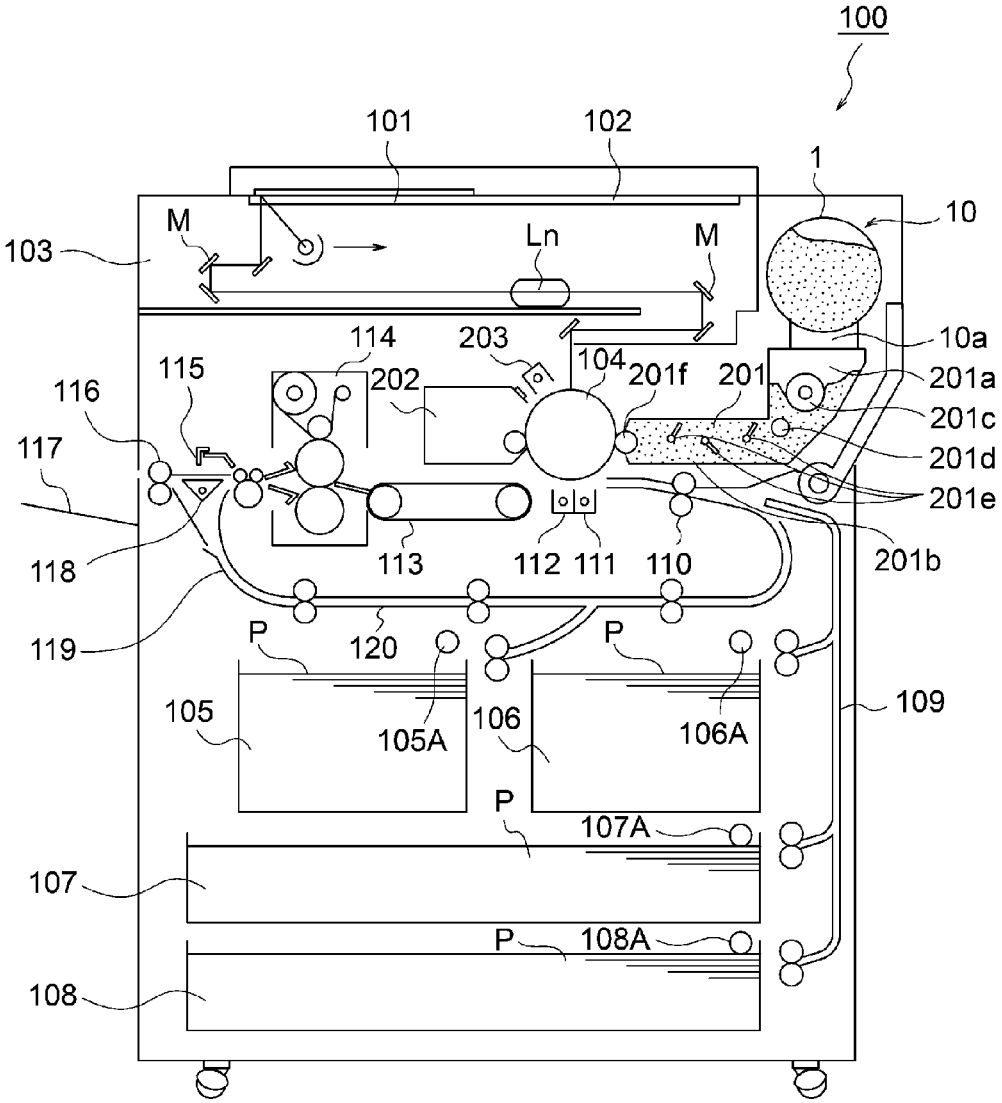
FIG. 1 is a sectional view illustrating a general arrangement of an image forming apparatus.

Referring to FIG. 1, the description will be made as to structures of a copying machine (electrophotographic image forming apparatus) employing an electrophotographic type process as an example of an image forming apparatus using a developer replenishing apparatus to which a developer supply container (so-called toner cartridge) is detachably mountable.

In the Figure, designated by 100 is a main assembly of the copying machine (main assembly of the image forming apparatus or main assembly of the apparatus). Designated by 101 is an original which is placed on an original supporting platen glass 102. A light image corresponding to image information of the original is imaged on an electrophotographic photosensitive member 104 (photosensitive member) by way of a plurality of mirrors M of an optical portion 103 and a lens Ln, so that an electrostatic latent image is formed. The electrostatic latent image is visualized with toner (one component magnetic toner) as a developer (dry powder) by a dry type developing device (one component developing device) 201*b*.

In this embodiment, the one component magnetic toner is used as the developer to be supplied from a developer supply container 1, but the present invention is not limited to the example and includes other examples which will be described hereinafter.

Specifically, in the case that a one component developing device using the one component non-magnetic toner is employed, the one component non-magnetic toner is supplied as the developer. In addition, in the case that a two component developing device using a two component developer containing mixed magnetic carrier and non-magnetic toner is employed, the non-magnetic toner is supplied as the developer. In such a case, both of the non-magnetic toner and the magnetic carrier may be supplied as the developer.

Designated by 105-108 are cassettes accommodating recording materials (sheets) S. Of the sheet S stacked in the cassettes 105-108, an optimum cassette is selected on the basis of a sheet size of the original 101 or information inputted by the operator (user) from a liquid crystal operating portion of the copying machine. The recording material is not limited to a sheet of paper, but OHP sheet or another material can be used as desired.

One sheet S supplied by a separation and feeding device 105A-108A is fed to registration rollers 110 along a feeding portion 109, and is fed at timing synchronized with rotation of a photosensitive member 104 and with scanning of an optical portion 103.

Designated by 111, 112 are a transfer charger and a separation charger. An image of the developer formed on the photosensitive member 104 is transferred onto the sheet S by a transfer charger 111. Then, the sheet S carrying the developed image (toner image) transferred thereonto is separated from the photosensitive member 104 by the separation charger 112.

Thereafter, the sheet S fed by the feeding portion 113 is subjected to heat and pressure in a fixing portion 114 so that the developed image on the sheet is fixed, and then passes through a discharging/reversing portion 115, in the case of one-sided copy mode, and subsequently the sheet S is discharged to a discharging tray 117 by discharging rollers 116.

In the case of a duplex copy mode, the sheet S enters the discharging/reversing portion 115 and a part thereof is ejected once to an outside of the apparatus by the discharging roller 116. The trailing end thereof passes through a flapper 118, and a flapper 118 is controlled when it is still nipped by the discharging rollers 116, and the discharging rollers 116 are rotated reversely, so that the sheet S is refed into the apparatus. Then, the sheet S is fed to the registration rollers 110 by way of re-feeding portions 119, 120, and then conveyed along the path similarly to the case of the one-sided copy mode and is discharged to the discharging tray 117.

In the main assembly of the apparatus 100, around the photosensitive member 104, there are provided image forming process equipment (process means) such as a developing device 201*b* as the developing means a cleaner portion 202 as a cleaning means, a primary charger 203 as charging means. The developing device 201*b* develops the electrostatic latent image formed on the photosensitive member 104 uniformly charged by the optical portion 103 in accordance with image information of the 101, by depositing the developer (toner) onto the latent image.

The developer supply container 1 for supplying the toner as the developer into the developing device 201*b* is detachably mountable to the main assembly 100 by a user. The present invention is applicable to the case in which only the toner is supplied or in which both of the toner and a carrier are supplied, from the developer supply container 1 into the image forming apparatus side.

A developer hopper portion 201*a* as accommodating means includes a stirring member 201*c* for stirring the developer supplied from the developer supply container 1. The developer stirred by the stirring member 201*c* is fed into the developing device 201*b* by a magnet roller 201*d*. The developing device 201*b* includes a developing roller 201*f* and a feeding member 201*e*. The developer fed from the developer hopper portion 201*a* by the magnet roller 201*d* is supplied onto the developing roller 201*f* by the feeding member 201*e* such that the developer is applied to the photosensitive member 104 by the developing roller 201*f*. The cleaner portion 202 functions to remove the residual developer from the photosensitive member 104. The primary charger 203 functions to uniformly charge the surface of the photosensitive member 104 so that an intended electrostatic image is formed on the photosensitive member 104.

(Developer Supplying Apparatus)

Referring to FIGS. 1-4, a developer replenishing apparatus 201 which is a constituent-element of the developer supplying system will be described. Part (a) of FIG. 2 is a partially sectional view of the developer supplying apparatus, (b) is a perspective view of a mounting portion, and (c) is a sectional view of the mounting portion.

FIG. 3 is partly enlarged sectional views of a control system, the developer supply container 1 and the developer replenishing apparatus 201. FIG. 4 is a flow chart illustrating a flow of developer supply operation by the control system.

As shown in FIG. 1, the developer replenishing apparatus 201 comprises the mounting portion (mounting space) 10, to which the developer supply container 1 is mounted demountably, a hopper 10*a* for storing temporarily the developer discharged from the developer supply container 1, and the developing device 201*b* 999 and the 9. As shown in part (c) of FIG. 2, the developer supply container 1 is mountable in a direction indicated by M to the mounting portion 10. Thus, a longitudinal direction (rotational axis direction) of the developer supply container 1 is substantially the same as the direction M. The direction M is substantially parallel with a direction indicated by X of part (b) of FIG. 8 which will be described hereinafter. In addition, a dismounting direction of the developer supply container 1 from the mounting portion 10 is opposite the direction (inserting direction) M.

As shown in parts (a) of FIGS. 1 and 2, the developing device 201*b* comprises a developing roller 201*f*, a stirring member 201*c*, a magnet roller 201*d*, and a feeding member 201*e*. The developer supplied from the developer supply container 1 is stirred by the stirring member 201*c*, is fed to the developing roller 201*f* by the magnet roller 201*d* and the feeding member 201*e*, and is supplied to the photosensitive member 104 by the developing roller 201*f*.

A developing blade 201 *g* for regulating an amount of developer coating on the roller is provided relative to the developing roller 201*f*, and a leakage preventing sheet 201*h* is provided contacted to the developing roller 201*f* to prevent leakage of the developer between the developing device 201*b* and the developing roller 201*f*.

As shown in part (b) of FIG. 2, the mounting portion 10 is provided with a rotation regulating portion (holding mechanism) 11 for limiting movement of the flange portion 4 in the rotational moving direction by abutting to a flange portion 4 (FIG. 6) of the developer supply container 1 when the developer supply container 1 is mounted.

Furthermore, the mounting portion 10 is provided with a developer receiving port (developer reception hole or developer receiving portion) 13 for receiving the developer discharged from the developer supply container 1, and the developer receiving port is brought into fluid communication with a discharge opening (discharging port) 4*a* (FIG. 6) of the developer supply container 1 which will be described hereinafter, when the developer supply container 1 is mounted thereto. The developer is supplied from the discharge opening 4*a* of the developer supply container 1 to the developing device 201*b* through the developer receiving port 13. In this embodiment, a diameter ϕ of the developer receiving port 13 is approx. 3 mm (pin hole), for the purpose of preventing as much as possible the contamination by the developer in the mounting portion 10. The diameter of the developer receiving port may be any if the developer can be discharged through the discharge opening 4*a*.

As shown in FIG. 3, the hopper 10*a* comprises a feeding screw 10*b* for feeding the developer to the developing device 201*b* an opening 10*c* in fluid communication with the developing device 201*b* and a developer sensor 10*d* for detecting an amount of the developer accommodated in the hopper 10*a*.

As shown in parts (b) and (c) of FIG. 2, the mounting portion 10 is provided with a driving gear 300 functioning as a driving mechanism (driver). The driving gear 300 receives a rotational force from a driving motor 500 (FIG. 3) through a driving gear train, and functions to apply a rotational force to the developer supply container 1 which is set in the mounting portion 10.

As shown in FIG. 3, the driving motor 500 is controlled by a control device (CPU) 600. As shown in FIG. 3, the control device 600 controls the operation of the driving motor 500 on the basis of information indicative of a developer remainder inputted from the developer sensor 10*d*.

In this example, the driving gear 300 is rotatable unidirectionally to simplify the control for the driving motor 500. The control device 600 controls only ON (operation) and OFF (non-operation) of the driving motor 500. This simplifies the driving mechanism for the developer replenishing apparatus 201 as compared with a structure in which forward and backward driving forces are provided by periodically rotating the driving motor 500 (driving gear 300) in the forward direction and backward direction. As will be described hereinafter, the mounting portion 10 is provided with a detecting portion 600*a* for assisting the control device 600 in rendering OFF the driving motor 500.

(Mounting/Dismounting Method of Developer Supply Container)

The description will be made as to mounting/dismounting method of the developer supply container 1.

First, the operator opens an exchange cover and inserts and mounts the developer supply container 1 to a mounting portion 10 of the developer replenishing apparatus 201. By the mounting operation, the flange portion 4 of the developer supply container 1 is held and fixed in the developer replenishing apparatus 201.

Thereafter, the operator closes the exchange cover to complete the mounting step. Thereafter, the control device 600 controls the driving motor 500, by which the driving gear 300 rotates at proper timing.

On the other hand, when the developer supply container 1 becomes empty, the operator opens the exchange cover and takes the developer supply container 1 out of the mounting portion 10. The operator inserts and mounts a new developer supply container 1 prepared beforehand and closes the exchange cover, by which the exchanging operation from the removal to the remounting of the developer supply container 1 is completed.

(Developer Supply Control by Developer Replenishing Apparatus)

Referring to a flow chart of FIG. 4, a developer supply control by the developer replenishing apparatus 201 will be described. The developer supply control is executed by controlling various equipment by the control device (CPU) 600.

In this example, the control device (controller) 600 controls the operation/non-operation of the driving motor 500 in accordance with an output of the developer sensor 10*d* by which the developer is not accommodated in the hopper 10*a* beyond a predetermined amount.

More particularly, first, the developer sensor 10*d* checks the accommodated developer amount in the hopper 10*a*. When the accommodated developer amount detected by the developer sensor 10*d* is discriminated as being less than a predetermined amount, that is, when no developer is detected by the developer sensor 10*d*, the driving motor 500 is actuated to execute a developer supplying operation for a predetermined time period (S101).

The accommodated developer amount detected with developer sensor 10*d* is discriminated as having reached the predetermined amount, that is, when the developer is detected by the developer sensor 10*d*, as a result of the developer supplying operation, the driving motor 500 is deactuated to stop the developer supplying operation (S102). By the stop of the supplying operation, a series of developer supplying steps is completed.

Such developer supplying steps are carried out repeatedly whenever the accommodated developer amount in the hopper 10*a* becomes less than a predetermined amount as a result of consumption of the developer by the image forming operations.

The structure may be such that the developer discharged from the developer supply container 1 is stored temporarily in the hopper 10*a*, and then is supplied into the developing device 201*b*. More specifically, the following structure of the developer replenishing apparatus 201 can be employed.

As shown in FIG. 5, the above-described hopper 10*a* is omitted, and the developer is supplied directly into the developing device 201*b* from the developer supply container 1. FIG. 5 shows an example using a two component developing device 800 as a developer replenishing apparatus 201. The developing device 800 comprises a stirring chamber into which the developer is supplied, and a developer chamber for supplying the developer to the developing sleeve 800*a*, wherein the stirring chamber and the developer chamber are provided with stirring screws 800*b* rotatable in such directions that the developer is fed in the opposite directions from each other. The stirring chamber and the developer chamber are communicated with each other in the opposite longitudinal end portions, and the two component developer are circulated the two chambers. The stirring chamber is provided with a magnetometric sensor 800*c* for detecting a toner content of the developer, and on the basis of the detection result of the magnetometric sensor 800*c*, the control device 600 controls the operation of the driving motor 500. In such a case, the developer supplied from the developer supply container is non-magnetic toner or non-magnetic toner plus magnetic carrier.

In this example, as will be described hereinafter, the developer in the developer supply container 1 is hardly discharged through the discharge opening 4*a* only by the gravitation, but the developer is discharged by a volume changing operation of a pump portion 3*b*, and therefore, variation in the discharge amount can be suppressed. Therefore, the developer supply container 1 which will be described hereinafter is usable for the example of FIG. 5 lacking the hopper 10*a*, and the supply of the developer into the developing chamber is stable with such a structure.

(Developer Supply Container)

Referring to FIGS. 6 and 7, the structure of the developer supply container 1 which is a constituent-element of the developer supplying system will be described. Part (a) of FIG. 6 is a perspective view illustrating the developer supply container according to Embodiment 1 of the present invention, (b) is a partial enlarged view illustrating a state around a discharge opening, and (c) is a front view illustrating a state in which the developer supply container is mounted to the mounting portion of the developer supplying apparatus. FIG. 7 is a perspective view of a section of the developer supply container. Part (a) of FIG. 8 is a partially sectional view in a state in which the pump portion is expanded to the maximum usable limit, and (b) is a partially sectional view in a state in which the pump portion is contracted to the maximum usable limit.

As shown in part (a) of FIG. 6, the developer supply container 1 includes a developer accommodating portion 2 (container body) having a hollow cylindrical inside space for accommodating the developer. In this example, a cylindrical portion 2*k*, the discharging portion 4*c* and the pump portion 3*a* (FIG. 5) function as the developer accommodating portion 2. Furthermore, the developer supply container 1 is provided with a flange portion 4 (non-rotatable portion) at one end of the developer accommodating portion 2 with respect to the longitudinal direction (developer feeding direction). The cylindrical portion 2 is rotatable relative to the flange portion 4. A cross-sectional configuration of the cylindrical portion 2*k* may be non-circular as long as the non-circular shape does not adversely affect the rotating operation in the developer supplying step. For example, it may be oval configuration, polygonal configuration or the like.

In this example, as shown in part (a) of FIG. 8, a total length L1 of the cylindrical portion 2*k* functioning as the developer accommodating chamber is approx. 460 mm, and an outer diameter R1 is approx. 60 mm. A length L2 of the range in which the discharging portion 4*c* functioning as the developer discharging chamber is approx. 21 mm. A total length L3 of the pump portion 3*b* (in the state that it is most expanded in the expansible range in use) is approx. 29 mm, and a total length L4 of the pump portion 3*a* (in the state that it is most contracted in the expansible range in use) is approx. 24.

As shown in FIGS. 6, 7, in this example, in the state that the developer supply container 1 is mounted to the developer replenishing apparatus 201, the cylindrical portion 2*k* and the discharging portion 4*c* are substantially on line along a horizontal direction. That is, the cylindrical portion 2*k* has a sufficiently long length in the horizontal direction as compared with the length in the vertical direction, and one end part with respect to the horizontal direction is connected with the discharging portion 4*c*. For this reason, an amount of the developer existing above the discharge opening 4*a* which will be described hereinafter can be made smaller as compared with the case in which the cylindrical portion 2*k* is above the discharging portion 4*c* in the state that the developer supply container 1 is mounted to the developer replenishing apparatus 201. Therefore, the developer in the neighborhood of the discharge opening 4*a* is less compressed, thus accomplishing smooth suction and discharging operation.

(Material of Developer Supply Container)

In this example, as will be described hereinafter, the developer is discharged through the discharge opening 4*a* by changing an internal volume of the developer supply container 1 by the pump portion 3*a*. Therefore, the material of the developer supply container 1 is preferably such that it provides an enough rigidity to avoid collision or extreme expansion against the volume change.

In addition, in this example, the developer supply container 1 is in fluid communication with an outside only through the discharge opening 4*a*, and is sealed except for the discharge opening 4*a*. Such a hermetical property as is enough to maintain a stabilized discharging performance in the discharging operation of the developer through the discharge opening 4*a* is provided by the decrease and increase of the volume of developer supply container 1 by the pump portion 3*a*.

Under the circumstances, this example employs polystyrene resin material as the materials of the developer accommodating portion 2 and the discharging portion 4*c* and employs polypropylene resin material as the material of the pump portion 3*a*.

As for the material for the developer accommodating portion 2 and the discharging portion 4*c*, other resin materials such as ABS (acrylonitrile, butadiene, styrene copolymer resin material), polyester, polyethylene, polypropylene, for example are usable if they have enough durability against the volume change. Alternatively, they may be metal.

As for the material of the pump portion 3*a*, any material is usable if it is expansible and contractable enough to change the internal pressure of the developer supply container 1 by the volume change. The examples includes thin formed ABS (acrylonitrile, butadiene, styrene copolymer resin material), polystyrene, polyester, polyethylene materials. Alternatively, other expandable-and-contractable materials such as rubber are usable.

They may be integrally molded of the same material through an injection molding method, a blow molding method or the like if the thicknesses are properly adjusted for the pump portion 3*a*, developer accommodating portion 2 and the discharging portion 3*h*, respectively.

In the following, the description will be made as to the structures of the flange portion 4, the cylindrical portion 2*k*, the pump portion 3*a*, the drive receiving mechanism 2*d*, a drive converting mechanism 2*e* (cam groove).

(Flange Portion)

As shown in FIG. 7 and part (a) of FIG. 8, the flange portion 4 is provided with a hollow discharging portion (developer discharging chamber) 4*c* for temporarily storing the developer having been fed from the inside of the developer accommodating portion (inside of the developer accommodating chamber) 2. A bottom portion of the discharging portion 4*c* is provided with the small discharge opening 4*a* for permitting discharge of the developer to the outside of the developer supply container 1, that is, for supplying the developer into the developer replenishing apparatus 201. The size of the discharge opening 4*a* will be described hereinafter.

The flange portion 4 is provided with a shutter 4*b* for opening and closing the discharge opening 4*a*. The shutter 4*b* is provided at a position such that when the developer supply container 1 is mounted to the mounting portion 10, it is abutted to an abutting portion 21 (see part (b) of FIG. 2 if necessary) provided in the mounting portion 10. Therefore, the shutter 4*b* slides relative to the developer supply container 1 in the rotational axis direction (opposite from the M direction) of the cylindrical 2*k* with the mounting operation of the developer supply container 1 to the mounting portion 10. As a result, the discharge opening 4*a* is exposed through the shutter 4*b*, thus completing the unsealing operation.

At this time, the discharge opening 4*a* is positionally aligned with the developer receiving port 13 of the mounting portion 10, and therefore, they are brought into fluid communication with each other, thus enabling the developer supply from the developer supply container 1.

The flange portion 4 is constructed such that when the developer supply container 1 is mounted to the mounting portion 10 of the developer replenishing apparatus 201, it is stationary substantially.

More particularly, a rotational direction regulating portion 11 shown in part (b) of FIG. 2 is provided so that the flange portion 4 does not rotate in the rotational direction of the cylindrical portion 2*k*.

Therefore, in the state that the developer supply container 1 is mounted to the developer replenishing apparatus 201, the discharging portion 4*c* provided in the flange portion 4 is prevented substantially in the movement of the cylindrical portion 2*k* in the rotational moving direction (movement within the play is permitted).

On the other hand, the cylindrical portion 2*k* is not limited in the rotational moving direction by the developer replenishing apparatus 201, and therefore, is rotatable in the developer supplying step.

(Discharge Opening of Flange Portion)

In this example, the size of the discharge opening 4*a* of the developer supply container 1 is so selected that in the orientation of the developer supply container 1 for supplying the developer into the developer replenishing apparatus 201, the developer is not discharged to a sufficient extent, only by the gravitation. The opening size of the discharge opening 4*a* is so small that the discharging of the developer from the developer supply container is insufficient only by the gravitation, and therefore, the opening is called pin hole hereinafter. In other words, the size of the opening is determined such that the discharge opening 4*a* is substantially clogged. This is expectedly advantageous in the following points.

(1) the developer does not easily leak through the discharge opening 4*a*.

(2) excessive discharging of the developer at time of opening of the discharge opening 4*a* can be suppressed.

(3) the discharging of the developer can rely dominantly on the discharging operation by the pump portion 3*a*.

The inventors have investigated as to the size of the discharge opening 4*a* not enough to discharge the toner to a sufficient extent only by the gravitation. The verification experiment (measuring method) and criteria will be described.

A rectangular parallelopiped container of a predetermined volume in which a discharge opening (circular) is formed at the center portion of the bottom portion is prepared, and is filled with 200 g of developer; then, the filling port is sealed, and the discharge opening is plugged; in this state, the container is shaken enough to loosen the developer. The rectangular parallelopiped container has a volume of 1000 $cm^3$, 90 mm in length, 92 mm width and 120 mm in height.

Thereafter, as soon as possible the discharge opening is unsealed in the state that the discharge opening is directed downwardly, and the amount of the developer discharged through the discharge opening is measured. At this time, the rectangular parallelopiped container is sealed completely except for the discharge opening. In addition, the verification experiments were carried out under the conditions of the temperature of 24° C. and the relative humidity of 55%.

Using these processes, the discharge amounts are measured while changing the kind of the developer and the size of the discharge opening. In this example, when the amount of the discharged developer is not more than 2 g, the amount is negligible, and therefore, the size of the discharge opening at that time is deemed as being not enough to discharge the developer sufficiently only by the gravitation.

The developers used in the verification experiment are shown in Table 1. The kinds of the developer are one component magnetic toner, non-magnetic toner for two component developer developing device and a mixture of the non-magnetic toner and the magnetic carrier.

As for property values indicative of the property of the developer, the measurements are made as to angles of rest indicating flowabilities, and fluidity energy indicating easiness of loosing of the developer layer, which is measured by a powder flowability analyzing device (Powder Rheometer FT4 available from Freeman Technology)

TABLE 1

| Developers | Volume average particle size of toner (μm) | Developer component | Angle of rest (deg.) | Fluidity energy (Bulk density of 0.5 g/$cm^3$) |
|---|---|---|---|---|
| A | 7 | Two-component non-magnetic | 18 | $2.09 \times 10^{-3}$ J |
| B | 6.5 | Two-component non-magnetic toner + carrier | 22 | $6.80 \times 10^{-4}$ J |
| C | 7 | One-component magnetic toner | 35 | $4.30 \times 10^{-4}$ J |
| D | 5.5 | Two-component non-magnetic toner + carrier | 40 | $3.51 \times 10^{-3}$ J |
| E | 5 | Two-component non-magnetic toner + carrier | 27 | $4.14 \times 10^{-3}$ J |

Referring to FIG. 9, a measuring method for the fluidity energy will be described. Here, FIG. 9 is a schematic view of a device for measuring the fluidity energy.

The principle of the powder flowability analyzing device is that a blade is moved in a powder sample, and the energy required for the blade to move in the powder, that is, the fluidity energy, is measured. The blade is of a propeller type, and when it rotates, it moves in the rotational axis direction simultaneously, and therefore, a free end of the blade moves helically.

The propeller type blade 54 is made of SUS (type=C210) and has a diameter of 48 mm, and is twisted smoothly in the counterclockwise direction. More specifically, from a center of the blade of 48 mm×10 mm, a rotation shaft extends in a normal line direction relative to a rotation plane of the blade, a twist angle of the blade at the opposite outermost edge portions (the positions of 24 mm from the rotation shaft) is 70°, and a twist angle at the positions of 12 mm from the rotation shaft is 35°.

The fluidity energy is total energy provided by integrating with time a total sum of a rotational torque and a vertical load when the helical rotating blade 54 enters the powder layer and advances in the powder layer. The value thus obtained indicates easiness of loosening of the developer powder layer, and large fluidity energy means less easiness and small fluidity energy means greater easiness.

In this measurement, as shown in FIG. 9, the developer T is filled up to a powder surface level of 70 mm (L2 in FIG. 9) into the cylindrical container 53 having a diameter ϕ of 50 mm (volume=200 cc, L1 (FIG. 9)=50 mm) which is the standard part of the device. The filling amount is adjusted in accordance with a bulk density of the developer to measure. The blade 54 of ϕ48 mm which is the standard part is advanced into the powder layer, and the energy required to advance from depth 10 mm to depth 30 mm is displayed.

The set conditions at the time of measurement are,

The rotational speed of the blade 54 (tip speed=peripheral speed of the outermost edge portion of the blade) is 60 mm/s:

The blade advancing speed in the vertical direction into the powder layer is such a speed that an angle θ (helix angle) formed between a track of the outermost edge portion of the blade 54 during advancement and the surface of the powder layer is 10°:

The advancing speed into the powder layer in the perpendicular direction is 11 mm/s (blade advancement speed in the powder layer in the vertical direction=(rotational speed of blade)×tan (helix angle×π/180)): and The measurement is carried out under the condition of temperature of 24° C. and relative humidity of 55%.

The bulk density of the developer when the fluidity energy of the developer is measured is close to that when the experiments for verifying the relation between the discharge amount of the developer and the size of the discharge opening, is less changing and is stable, and more particularly is adjusted to be 0.5 g/cm$^3$.

The verification experiments were carried out for the developers (Table 1) with the measurements of the fluidity energy in such a manner. FIG. 10 is a graph showing relations between the diameters of the discharge openings and the discharge amounts with respect to the respective developers.

From the verification results shown in FIG. 10, it has been confirmed that the discharge amount through the discharge opening is not more than 2 g for each of the developers A-E, if the diameter ϕ of the discharge opening is not more than 4 mm (12.6 mm$^2$ in the opening area (circle ratio=3.14)). When the diameter ϕ discharge opening exceeds 4 mm, the discharge amount increases sharply.

The diameter ϕ of the discharge opening is preferably not more than 4 mm (12.6 mm$^2$ of the opening area) when the fluidity energy of the developer (0.5 g/cm$^3$ of the bulk density) is not less than $4.3\times10^{-4}$ kg-m$^2$/s$^2$ (J) and not more than $4.14\times10^{-3}$ kg-m$^2$/s$^2$ (J).

As for the bulk density of the developer, the developer has been loosened and fluidized sufficiently in the verification experiments, and therefore, the bulk density is lower than that expected in the normal use condition (left state), that is, the measurements are carried out in the condition in which the developer is more easily discharged than in the normal use condition.

The verification experiments were carries out as to the developer A with which the discharge amount is the largest in the results of FIG. 10, wherein the filling amount in the container were changed in the range of 30-300 g while the diameter ϕ of the discharge opening is constant at 4 mm. The verification results are shown in FIG. 11. From the results of FIG. 11, it has been confirmed that the discharge amount through the discharge opening hardly changes even if the filling amount of the developer changes.

From the foregoing, it has been confirmed that by making the diameter ϕ of the discharge opening not more than 4 mm (12.6 mm$^2$ in the area), the developer is not discharged sufficiently only by the gravitation through the discharge opening in the state that the discharge opening is directed downwardly (supposed supplying attitude into the developer replenishing apparatus 201) irrespective of the kind of the developer or the bulk density state.

On the other hand, the lower limit value of the size of the discharge opening 4*a* is preferably such that the developer to be supplied from the developer supply container 1 (one component magnetic toner, one component non-magnetic toner, two component non-magnetic toner or two component magnetic carrier) can at least pass therethrough. More particularly, the discharge opening is preferably larger than a particle size of the developer (volume average particle size in the case of toner, number average particle size in the case of carrier) contained in the developer supply container 1. For example, in the case that the supply developer comprises two component non-magnetic toner and two component magnetic carrier, it is preferable that the discharge opening is larger than a larger particle size, that is, the number average particle size of the two component magnetic carrier.

Specifically, in the case that the supply developer comprises two component non-magnetic toner having a volume average particle size of 5.5 μm and a two component magnetic carrier having a number average particle size of 40 μm, the diameter of the discharge opening 4*a* is preferably not less than 0.05 mm (0.002 mm$^2$ in the opening area).

If, however, the size of the discharge opening 4*a* is too close to the particle size of the developer, the energy required for discharging a desired amount from the developer supply container 1, that is, the energy required for operating the pump portion 3*a* is large. It may be the case that a restriction is imparted to the manufacturing of the developer supply container 1. In order to mold the discharge opening 4*a* in a resin material part using an injection molding method, a metal mold part for forming the discharge opening 4*a* is used, and the durability of the metal mold part will be a problem. From the foregoing, the diameter ϕ of the discharge opening 4*a* is preferably not less than 0.5 mm.

In this example, the configuration of the discharge opening 4*a* is circular, but this is not inevitable. A square, a rectangular, an ellipse or a combination of lines and curves or the like are usable if the opening area is not more than 12.6 mm$^2$ which is the opening area corresponding to the diameter of 4 mm.

However, a circular discharge opening has a minimum circumferential edge length among the configurations having the same opening area, the edge being contaminated by the deposition of the developer. Therefore, the amount of the developer dispersing with the opening and closing operation of the shutter 4*b* is small, and therefore, the contamination is decreased. In addition, with the circular discharge opening, a resistance during discharging is also small, and a discharging property is high. Therefore, the configuration of the discharge opening 4*a* is preferably circular which is excellent in the balance between the discharge amount and the contamination prevention.

From the foregoing, the size of the discharge opening 4*a* is preferably such that the developer is not discharged sufficiently only by the gravitation in the state that the discharge opening 4*a* is directed downwardly (supposed supplying attitude into the developer replenishing apparatus 201). More particularly, a diameter ϕ of the discharge opening 4*a* is not less than 0.05 mm (0.002 mm$^2$ in the opening area) and not more than 4 mm (12.6 mm$^2$ in the opening area). Furthermore, the diameter ϕ of the discharge opening 4*a* is preferably not less than 0.5 mm (0.2 mm$^2$ in the opening area and not more than 4 mm (12.6 $mm^2$ in the opening area). In this example, on the basis of the foregoing investigation, the discharge opening 4*a* is circular, and the diameter ϕ of the opening is 2 mm.

In this example, the number of discharge openings 4*a* is one, but this is not inevitable, and a plurality of discharge openings 4*a*, if the respective opening areas satisfy the above-described range. For example, in place of one developer receiving port 13 having a diameter ϕ of 3 mm, two discharge openings 4*a* each having a diameter ϕ of 0.7 mm are employed. However, in this case, the discharge amount of the developer per unit time tends to decrease, and therefore, one discharge opening 4*a* having a diameter ϕ of 2 mm is preferable.

(Cylindrical Portion)

Referring to FIGS. 6, 7, the cylindrical portion 2*k* functioning as the developer accommodating chamber will be described.

As soon in FIGS. 6 and 7, an inner surface of the cylindrical portion 2*k* is provided with a feeding portion 2*c* which is projected and extended helically, the feeding portion 2*c* functioning as means for feeding the developer accommodated in the developer accommodating portion 2 toward the discharging portion 4*c* (discharge opening 4*a*) functioning as the developer discharging chamber, with rotation of the cylindrical portion 2*k*.

The cylindrical portion 2*k* is formed by a blow molding method from an above-described resin material.

In order to increase a filling capacity by increasing the volume of the developer supply container 1, it would be considered that the height of the flange portion 4 as the developer accommodating portion 2 is increased to increase the volume thereof. However, with such a structure, the gravitation to the developer adjacent the discharge opening 4*a* increases due to the increased weight of the developer. As a result, the developer adjacent the discharge opening 4*a* tends to be compacted with the result of obstruction to the suction/discharging through the discharge opening 4*a*. In this case, in order to loosen the developer compacted by the suction through the discharge opening 4*a* or in order to discharge the developer by the discharging, the volume change of the pump portion 3*a* has to be increased. As a result, the driving force for driving the pump portion 3*a* has to be increased, and the load to the main assembly of the image forming apparatus 100 may be increased to an extreme extent.

In this example, the cylindrical portion 2*k* extends in the horizontal direction from the flange portion 4, and therefore, the thickness of the developer layer on the discharge opening 4*a* in the developer supply container 1 can be made small as compared with the above-described high structure. By doing so, the developer does not tend to be compacted by the gravitation, and therefore, the developer can be discharged stably without large load to the main assembly of the image forming apparatus 100.

As shown in part (a) and part (b) of FIG. 8, the cylindrical portion 2*k* is fixed rotatably relative to the flange portion 4 with a flange seal 5*b* of a ring-like sealing member provided on the inner surface of the flange portion 4 being compressed.

By this, the cylindrical portion 2*k* rotates while sliding relative to the flange seal 5*b*, and therefore, the developer does not leak out during the rotation, and a hermetical property is provided. Thus, the air can be brought in and out through the discharge opening 4*a*, so that desired states of the volume change of the developer supply container 1 during the developer supply can be accomplished.

(Pump Portion)

Referring to FIG. 7, the description will be made as to the pump portion (reciprocable pump) 3*a* in which the volume thereof changes with reciprocation. FIG. 7 is a perspective view of a section of the developer supply container, and part (a) of FIG. 8 is a partially sectional view in a state in which the pump portion is expanded to the maximum usable limit, and (b) is a partially sectional view in a state in which the pump portion is contracted to the maximum usable limit.

The pump portion 3*a* of this example functions as a suction and discharging mechanism for repeating the sucking operation and the discharging operation alternately through the discharge opening 4*a*. In other words, the pump portion 3*a* functions as an air flow generating mechanism for generating repeatedly and alternately air flow into the developer supply container and air flow out of the developer supply container through the discharge opening 4*a*.

As shown in part (a) of FIG. 8, the pump portion 3*a* is provided at a position away from the discharging portion 4*c* in a direction X. Thus, the pump portion 3*a* does not rotate in the rotational direction of the cylindrical portion 2*k* together with the discharging portion 4*c*.

In this example, the pump portion 3*a* is a displacement type pump (bellow-like pump) of resin material in which the volume thereof changes with the reciprocation. More particularly, as shown in parts (a) of FIG. 7 and part (b) of FIG. 8, the bellow-like pump includes crests and bottoms periodically and alternately. The pump portion 3*a* repeats the compression and the expansion alternately by the driving force received from the developer replenishing apparatus 201. In this example, the volume change by the expansion and contraction is 5 cm^3 (cc). The length L3 (part (a) of FIG. 8) is approx. 29 mm, the length L4 (part (b) of FIG. 8) is approx. 24 mm. The outer diameter R2 of the pump portion 3*a* is approx. 45 mm.

Using the pump portion 3*a* of such a structure, the volume of the developer supply container 1 can be alternately changed repeatedly at predetermined intervals. That is, as shown in part (a) of FIG. 8, the volume is large when the pump portion expands. The volume is the maximum when the pump portion expands most. On the other hand, as shown in part (b) of FIG. 8, the volume is small when the pump portion constructs. The volume is the minimum when the pump portion contracts most. In this manner, the volume changes with the expansion and contraction of the pump portion.

As a result, the developer in the discharging portion 4*c* can be discharged efficiently through the small diameter discharge opening 4*a* (diameter of approx. 2 mm).

(Drive Receiving Mechanism)

The description will be made as to a drive receiving mechanism (drive inputting portion, driving force receiving portion) of the developer supply container 1 for receiving the rotational force for rotating the feeding portion 2*c* from the developer replenishing apparatus 201.

As shown in part (a) of FIG. 6, the developer supply container 1 is provided with a gear portion 2*a* which functions as a drive receiving mechanism (drive inputting portion, driving force receiving portion) engageable (driving connection) with a driving gear 300 (functioning as driving mechanism) of the developer replenishing apparatus 201. The gear portion 2*d* and the cylindrical portion 2*k* are integrally rotatable.

Therefore, the rotational force inputted to the gear portion 2*d* from the driving gear 300 is transmitted to the pump portion 3*a* through a reciprocation member (drive transmission member) 3*b* shown in part (a) and (b) of FIG. 12, as will be described in detail hereinafter.

The bellow-like pump portion 3*a* of this example is made of a resin material having a high property against torsion or twisting about the axis within a limit of not adversely affecting the expanding-and-contracting operation.

In this example, the gear portion 2*d* is provided at one longitudinal end (developer feeding direction) of the cylindrical portion 2*k*, but this is not inevitable, and the gear portion 2*a* may be provided at the other longitudinal end side of the developer accommodating portion 2, that is, the trailing end portion. In such a case, the driving gear 300 is provided at a corresponding position.

In this example, a gear mechanism is employed as the driving connection mechanism between the drive receiving portion of the developer supply container 1 and the driver of the developer replenishing apparatus 201, but this is not inevitable, and a known coupling mechanism, for example is usable. More particularly, in such a case, the structure may be such that a non-circular recess is provided as a drive receiving portion, and correspondingly, a projection having a configuration corresponding to the recess as a driver for the developer replenishing apparatus 201, so that they are in driving connection with each other.

(Drive Converting Mechanism)

A drive converting mechanism (drive converting portion) for the developer supply container 1 will be described. In this example, a cam mechanism is taken as an example of the drive converting mechanism.

The developer supply container 1 is provided with the cam mechanism which functions as the drive converting mechanism (drive converting portion) for converting the rotational force for rotating the feeding portion 2*c* received by the gear portion 2*d* to a force in the reciprocating directions of the pump portion 3*a*.

In this example, one drive receiving portion (gear portion 2*d*) receives the driving force for rotating the feeding portion 2*c* and for reciprocating the pump portion 3*a*, and the rotational force received by the gear portion 2*d* is converted to a reciprocation force in the developer supply container 1 side.

Because of this structure, the structure of the drive receiving mechanism for the developer supply container 1 is simplified as compared with the case of providing the developer supply container 1 with two separate drive receiving portions. In addition, the drive is received by a single driving gear of developer replenishing apparatus 201, and therefore, the driving mechanism of the developer replenishing apparatus 201 is also simplified.

Part (a) of FIG. 12 is a partial view in a state in which the pump portion is expanded to the maximum usable limit, (b) is a partial view in a state in which the pump portion is contracted to the maximum usable limit, and (c) is a partial view of the pump portion. As shown in part (a) of FIG. 12 and part (b) of FIG. 12, the used member for converting the rotational force to the reciprocation force for the pump portion 3*a* is the reciprocation member (drive transmission member) 3*b*. More specifically, it includes a rotatable cam groove 2*e* extended on the entire circumference of the portion integral with the driven receiving portion (gear portion 2*d*) for receiving the rotation from the driving gear 300. The cam groove 2*e* constituting the drive converting portion will be described hereinafter. The cam groove 2*e* is engaged with an engaging projection (reciprocating member engaging projection, drive transmission member engaging projection) projected from the reciprocation member 3*b*. In this example, as shown in part (c) of FIG. 12, the reciprocation member 3*b* is limited in the movement in the rotational moving direction of the cylindrical portion 2*k* by a protecting member rotation regulating portion 3*f* (play will be permitted) so that the reciprocation member 3*b* does not rotate in the rotational direction of the cylindrical portion 2*k*. By the movement in the rotational moving direction limited in this manner, it reciprocates along the groove of the cam groove 2*e* (in the direction X shown in FIG. 7 or the opposite direction). A plurality of such engaging projections 3*c* are provided and are engaged with the cam groove 2*e*. More particularly, two engaging projections 3*c* are provided opposed to each other in the diametrical direction of the cylindrical portion 2*k* (approx. 180° opposing).

The number of the engaging projections 3*c* is satisfactory if it is not less than one. However, in consideration of the liability that a moment is produced by the drag force during the expansion and contraction of the pump portion 3*a* with the result of unsmooth reciprocation, the number is preferably plural as long as the proper relation is assured in relation to the configuration of the cam groove 2*e* which will be described hereinafter.

In this manner, by the rotation of the cam groove 2*e* by the rotational force received from the driving gear 300, the engaging projection 3*c* reciprocates in the X direction and the opposite direction along the cam groove 2*e*, by which the pump portion 3*a* repeats the expanded state (part (a) of FIG. 12) and the contracted state (part (b) of FIG. 12) alternately, thus changing the volume of the developer supply container 1.

(Set Conditions of Drive Converting Mechanism)

In this example, the drive converting mechanism effects the drive conversion such that an amount (per unit time) of developer feeding to the discharging portion 4*c* by the rotation of the cylindrical portion 2*k* is larger than a discharging amount (per unit time) to the developer replenishing apparatus 201 from the discharging portion 4*c* by the function of the pump portion.

This is because if the developer discharging power of the pump portion 3*a* is higher than the developer feeding power of the feeding portion 2*c* to the discharging portion 4*c*, the amount of the developer existing in the discharging portion 4*c* gradually decreases. In other words, it is avoided that the time period required for supplying the developer from the developer supply container 1 to the developer replenishing apparatus 201 is prolonged.

In addition, in the drive converting mechanism of this example, the drive conversion is such that the pump portion 3*a* reciprocates a plurality of times per one full rotation of the cylindrical portion 2*k*. This is for the following reasons.

In the case of the structure in which the cylindrical portion 2*k* is rotated inner the developer replenishing apparatus 201, it is preferable that the driving motor 500 is set at an output required to rotate the cylindrical portion 2*k* stably at all times. However, from the standpoint of reducing the energy consumption in the image forming apparatus as much as possible, it is preferable to minimize the output of the driving motor 500. The output required by the driving motor 500 is calculated from the rotational torque and the rotational frequency of the cylindrical portion 2*k*, and therefore, in order to reduce the output of the driving motor 500, the rotational frequency of the cylindrical portion 2*k* is minimized.

However, in the case of this example, if the rotational frequency of the cylindrical portion 2*k* is reduced, a number of operations of the pump portion 3*a* per unit time decreases, and therefore, the amount of the developer (per unit time) discharged from the developer supply container 1 decreases.

In other words, there is a possibility that the developer amount discharged from the developer supply container 1 is insufficient to quickly meet the developer supply amount required by the main assembly of the image forming apparatus 100.

If the amount of the volume change of the pump portion 3*a* is increased, the developer discharging amount per unit cyclic period of the pump portion 3*a* can be increased, and therefore, the requirement of the main assembly of the image forming apparatus 100 can be met, but doing so gives rise to the following problem.

If the amount of the volume change of the pump portion 3*a* is increased, a peak value of the internal pressure (positive pressure) of the developer supply container 1 in the discharging step increases, and therefore, the load required for the reciprocation of the pump portion 3*a* increases.

For this reason, in this example, the pump portion 3*a* operates a plurality of cyclic periods per one full rotation of the cylindrical portion 2*k*. By this, the developer discharge amount per unit time can be increased as compared with the case in which the pump portion 3*a* operates one cyclic period per one full rotation of the cylindrical portion 2*k*, without increasing the volume change amount of the pump portion 3*a*. Corresponding to the increase of the discharge amount of the developer, the rotational frequency of the cylindrical portion 2*k* can be reduced.

With the structure of this example, the required output of the driving motor 500 may be low, and therefore, the energy consumption of the main assembly of the image forming apparatus 100 can be reduced.

(Position of Drive Converting Mechanism)

As shown in FIG. 12, in this example, the drive converting mechanism (cam mechanism constituted by the engabing projection 3*c* and cam groove 2*e*) is provided outside of developer accommodating portion 2. More particularly, the drive converting mechanism is disposed at a position separated from the inside spaces of the cylindrical portion 2*k*, the pump portion 3*a* and the flange portion 4, so that the drive converting mechanism does not contact the developer accommodated inside the cylindrical portion 2*k*, the pump portion 3*a* and the flange portion 4.

By this, a problem which may arise when the drive converting mechanism is provided in the inside space of the developer accommodating portion 2 can be avoided. More particularly, the problem is that by the developer entering portions of the drive converting mechanism where sliding motions occur, the particles of the developer are subjected to heat and pressure to soften and therefore, they agglomerate into masses (coarse particle), or they enter into a converting mechanism with the result of torque increase. The problem can be avoided.

(Developer Supplying Step)

Referring to FIGS. 12 and 13, a developer supplying step by the pump portion 3*a* will be described.

In this example, as will be described hereinafter, the drive conversion of the rotational force is carries out by the drive converting mechanism so that the suction step by the pump operation (suction operation through discharge opening 4*a*), the discharging step (discharging operation through the discharge opening 4*a*) and the rest step by the non-operation of the pump portion (neither suction nor discharging is effected through the discharge opening 4*a*) are repeated alternately. The suction step, the discharging step and the rest step will be described.

(Suction Step)

First, the suction step (suction operation through discharge opening 4*a*) will be described.

As shown in part (a) of FIG. 11, the suction operation is effected by the pump portion 3*a* being changed from the most contracted state to the most expanded state by the above-described drive converting mechanism (cam mechanism). More particularly, by the suction operation, a volume of a portion of the developer supply container 1 (pump portion 3*a*, cylindrical portion 2*k* and flange portion 4) which can accommodate the developer increases.

At this time, the developer supply container 1 is substantially hermetically sealed except for the discharge opening 4*a*, and the discharge opening 3*a* is plugged substantially by the developer T. Therefore, the internal pressure of the developer supply container 1 decreases with the increase of the volume of the portion of the developer supply container 1 capable of containing the developer T.

At this time, the internal pressure of the developer supply container 1 is lower than the ambient pressure (external air pressure). For this reason, the air outside the developer supply container 1 enters the developer supply container 1 through the discharge opening 4*a* by a pressure difference between the inside and the outside of the developer supply container 1.

At this time, the air is taken-in from the outside of the developer supply container 1, and therefore, the developer T in the neighborhood of the discharge opening 4*a* can be loosened (fluidized). More particularly, the air impregnated into the developer powder existing in the neighborhood of the discharge opening 4*a*, thus reducing the bulk density of the developer powder T and fluidizing.

Since the air is taken into the developer supply container 1 through the discharge opening 4*a*, the internal pressure of the developer supply container 1 changes in the neighborhood of the ambient pressure (external air pressure) despite the increase of the volume of the developer supply container 1.

In this manner, by the fluidization of the developer T, the developer T does not pack or clog in the discharge opening 4*a*, so that the developer can be smoothly discharged through the discharge opening 4*a* in the discharging operation which will be described hereinafter. Therefore, the amount of the developer T (per unit time) discharged through the discharge opening 4*a* can be maintained substantially at a constant level for a long term.

For effecting the sucking operation, it is not inevitable that the pump portion 3*a* changes from the most contracted state to the most expanded state, but the sucking operation is effected if the internal pressure of the developer supply container 1 changes even if the pump portion changes from the most contracted state halfway to the most expanded state. That is, the suction stroke corresponds to the state in which the engaging projection 3*c* is engaged with the cam groove (second operation portion) 2*h* shown in FIG. 13.

(Discharging Stroke)

The discharging step (discharging operation through the discharge opening 4*a*) will be described.

As shown in part (b) of FIG. 12, the discharging operation is effected by the pump portion 3*a* being changed from the most expanded state to the most contracted state by above-described drive converting mechanism (cam mechanism). More particularly, by the discharging operation, a volume of a portion of the developer supply container 1 (pump portion 3*a*, cylindrical portion 2*k* and flange portion 4) which can accommodate the developer decreases. At this time, the developer supply container 1 is substantially hermetically sealed except for the discharge opening 4*a*, and the discharge opening 4*a* is plugged substantially by the developer T until the developer is discharged. Therefore, the internal pressure of the developer supply container 1 rises with the decrease of the volume of the portion of the developer supply container 1 capable of containing the developer T.

The internal pressure of the developer supply container 1 is higher than the ambient pressure (the external air pressure). Therefore, the developer T is pushed out by the pressure difference between the inside and the outside of the developer supply container 1. That is, the developer T is discharged from the developer supply container 1 into the developer replenishing apparatus 201.

Also air in the developer supply container 1 is also discharged with the developer T, and therefore, the internal pressure of the developer supply container 1 decreases.

As described in the foregoing, according to this example, the discharging of the developer can be effected efficiently using one reciprocation type pump portion 3*a*, and therefore, the mechanism for the developer discharging can be simplified.

For effecting the discharging operation, it is not inevitable that the pump portion 3*a* changes from the most expanded state to the most contracted state, but the discharging operation is effected if the internal pressure of the developer supply container 1 changes even if the pump portion changes from the most expanded state halfway to the most contracted state. That is, the discharging stroke corresponds to the state in which the engaging projection 3*c* is engaged with the cam groove 2 *g* shown in FIG. 13.

(Rest Stroke)

The rest stroke in which the pump portion 3*a* does not to reciprocate will be described.

In this example, as described hereinbefore, the operation of the driving motor 500 is controlled by the control device 600 on the basis of the results of the detection of the magnetometric sensor 800*c* and/or the developer sensor 10*d*. With such a structure, the amount of the developer discharged from the developer supply container 1 directly influences the toner content of the developer, and therefore, it is necessary to supply the amount of the developer required by the image forming apparatus from the developer supply container 1. At this time, in order to stabilize the amount of the developer discharged from the developer supply container 1, it is desirable that the amount of volume change at one time is constant.

If, for example, the cam groove 2*e* includes only the portions for the discharging stroke and the suction stroke, the motor actuation may stop at halfway of the discharging stroke or suction stroke. After the stop of the driving motor 500, the cylindrical portion 2*k* continues rotating by the inertia, by which the pump portion 3*a* continues reciprocating until the cylindrical portion 2*k* stops, during which the discharging stroke or the suction stroke continues. The distance through which the cylindrical portion 2*k* rotates by the inertia is dependent on the rotational speed of the cylindrical portion 2*k*. Further, the rotational speed of the cylindrical portion 2*k* is dependent on the torque applied to the driving motor 500. From this, the torque to the motor changes depending on the amount of the developer in the developer supply container 1, and the speed of the cylindrical portion 2*k* may also change, and therefore, it is difficult to stop the pump portion 3*a* at the same position.

In order to stop the pump portion 3*a* at the same position, a region in which the pump portion 3*a* does not reciprocate even during the rotation of the cylindrical portion 2*k* is required to be provided in the cam groove 2*e*. In this embodiment, for the purpose of preventing the reciprocation of the pump portion 3*a*, there is provided a cam groove 2*i* (FIG. 13) as a non-operation portion with which the rotational force inputted to the gear portion 2*d* is not converted to the force for operating the pump portion 3*a*. The cam groove 2*i* extends in the rotational moving direction of the cylindrical portion 2*k*, and therefore, the reciprocation member 3*b* does not move despite the rotation (straight shape). Cam groove 2*i* extends in the direction of an arrow A which is parallel with the rotational moving direction of the cylindrical portion 2*k*. That is, the rest stroke corresponds to the engaging projection 3*c* engaging with the cam groove (non-operation portion) 2*i*.

The non-reciprocation of the pump portion 3*a* means that the developer is not discharged through the discharge opening 4*a* (except for the developer falling through the discharge opening 4*a* due to the vibration or the like during the rotation of the cylindrical portion 2*k*). Thus, if the discharging stroke or suction stroke through the discharge opening 4*a* is not effected, the cam groove 2*i* may be inclined relative to the rotational moving direction toward the rotation axial direction. When the cam groove 2*i* is inclined, the reciprocation of the pump portion 3*a* corresponding to the inclination is permitted.

As will be described hereinafter, in this embodiment, the developer supply container 1 is provided with a phase detecting portion 6*a* as a phase detecting portion for stopping the rotation of the feeding portion 2*c* (cylindrical portion 2*k*), so that when the motor is stopped, the engaging projection 3*c* is engaged with the cam groove 2*i* which is the non-operation portion.

(Change of Internal Pressure of Developer Supply Container)

Verification experiments were carried out as to a change of the internal pressure of the developer supply container 1. The verification experiments will be described.

The developer is filled such that the developer accommodating space in the developer supply container 1 is filled with the developer; and the change of the internal pressure of the developer supply container 1 is measured when the pump portion 3*a* is expanded and contracted in a predetermined range (5 $cm^3$, here) of volume change. The internal pressure of the developer supply container 1 is measured using a pressure gauge (AP-C40 available from Kabushiki Kaisha KEYENCE) connected with the developer supply container 1.

FIG. 14 shows a pressure change when the pump portion 3*a* is expanded and contracted in the state that the shutter 4*b* of the developer supply container 1 filled with the developer is open, and therefore, in the communicatable state with the outside air.

In FIG. 14, the abscissa represents the time, and the ordinate represents a relative pressure in the developer supply container 1 relative to the ambient pressure (reference (1 kPa) (+ is a positive pressure side, and – is a negative pressure side).

When the internal pressure of the developer supply container 1 becomes negative relative to the outside ambient pressure by the increase of the volume of the developer supply container 1, the air is taken in through the discharge opening 4*a* by the pressure difference. When the internal pressure of the developer supply container 1 becomes positive relative to the outside ambient pressure by the decrease of the volume of the developer supply container 1, a pressure is imparted to the inside developer. At this time, the inside pressure eases corresponding to the discharged developer and air.

By the verification experiments, it has been confirmed that by the increase of the volume of the developer supply container 1, the internal pressure of the developer supply container 1 becomes negative relative to the outside ambient pressure, and the air is taken in by the pressure difference. In addition, it has been confirmed that by the decrease of the volume of the developer supply container 1, the internal pressure of the developer supply container 1 becomes positive relative to the outside ambient pressure, and the pressure is imparted to the inside developer so that the developer is discharged. In the verification experiments, an absolute value of the negative pressure is approx. 1.2 kPa, and an absolute value of the positive pressure is approx. 0.5 kPa.

As described in the foregoing, with the structure of the developer supply container 1 of this example, the internal pressure of the developer supply container 1 switches between the negative pressure and the positive pressure alternately by the suction operation and the discharging operation of the pump portion 3*a*, and the discharging of the developer is carried out properly.

As described in the foregoing, the example, a simple and easy pump portion capable of effecting the suction operation and the discharging operation of the developer supply container 1 is provided, by which the discharging of the developer by the air can be carries out stably while providing the developer loosening effect by the air.

In other words, with the structure of the example, even when the size of the discharge opening 4*a* is extremely small, a high discharging performance can be assured without imparting great stress to the developer since the developer can be passed through the discharge opening 4*a* in the state that the bulk density is small because of the fluidization.

In addition, in this example, the inside of the displacement type pump portion 3*a* is utilized as a developer accommodating space, and therefore, when the internal pressure is reduced by increasing the volume of the pump portion 3*a*, a additional developer accommodating space can be formed. Therefore, even when the inside of the pump portion 3*a* is filled with the developer, the bulk density can be decreased (the developer can be fluidized) by impregnating the air in the developer powder. Therefore, the developer can be filled in the developer supply container 1 with a higher density than in the conventional art.

(Modified Examples of Set Condition of Cam Groove)

Referring to FIG. 13, modified examples of the set condition of the cam groove 2*e* constituting the drive converting portion will be described. FIG. 13 is a developed view of the cam groove 2*e*. Referring to the developed view of the drive converting mechanism portion of FIG. 13, the description will be made as to the influence to the operational condition of the pump portion 3*a* when the configuration of the cam groove 3*e* is changed.

Here, in FIG. 13, an arrow A indicates a rotational moving direction of the cylindrical portion 2*k* (moving direction of the cam groove 2*e*); an arrow B indicates the expansion direction of the pump portion 3*a*; and an arrow C indicates a compression direction of the pump portion 3*a*.

The cam groove 2*e* constituting the drive converting portion includes the cam groove 2 *g* as a first operation portion for converting the rotational force inputted to the gear portion 2*d* to a force for decreasing the volume of the pump portion 3*a*, a cam groove 2*h* as a second operation portion for converting the inputted force to a force for increasing the volume of the pump portion, a cam groove 2*i* as the non-operation portion not converting the inputted force to a force operating the pump portion 3*a*. That is, the cam groove 2*e* includes the cam groove 2 *g* used when the pump portion 3*a* is compressed, the cam groove 2*h* used when the pump portion 3*a* is expanded, and the cam groove 2*i* not the reciprocating the pump portion 3*a*.

Furthermore, in FIG. 13, an angle formed between the cam groove 3*g* and the rotational moving direction An of the cylindrical portion 2*k* is α; an angle formed between the cam groove 2*h* and the rotational moving direction An is β; and an amplitude (expansion and contraction length of the pump portion 3*a*), in the expansion and contracting directions B, C of the pump portion 3*a*, of the cam groove is K1.

First, the description will be made as to the expansion and contraction length K1 of the pump portion 2*b*.

When the expansion and contraction length K1 is shortened, the volume change amount of the pump portion 3*a* decreases, and therefore, the pressure difference from the external air pressure is reduced. Then, the pressure imparted to the developer in the developer supply container 1 decreases, with the result that the amount of the developer discharged from the developer supply container 1 per one cyclic period (one reciprocation, that is, one expansion and contracting operation of the pump portion 3*a*) decreases.

From this consideration, as shown in FIG. 15, the amount of the developer discharged when the pump portion 3*a* is reciprocated once, can be decreased as compared with the structure of FIG. 13, if an amplitude K2 is selected so as to satisfy K2<K1 under the condition that the angles α and β are constant. On the contrary, if K2>K1, the developer discharge amount can be increased.

As regards the angles α and β of the cam groove, when the angles are increased, for example, the movement distance of the engaging projection 3*c* when the developer accommodating portion 2 rotates for a constant time increases if the rotational speed of the cylindrical portion 2*k* is constant, and therefore, as a result, the expansion-and-contraction speed of the pump portion 3*a* increases.

On the other hand, when the engaging projection 3*c* moves in the cam grooves 2 *g* and 2*h*, the resistance received from the cam grooves 2 *g* and 2*h* is large, and therefore, a torque required for rotating the cylindrical portion 2*k* increases as a result.

For this reason, as shown in FIG. 16, if the angle α' of the cam groove 2 *g* and the angle β' of the cam groove 2*h* are selected so as to satisfy α'>α and β'>β without changing the expansion and contraction length K1, the expansion-and-contraction speed of the pump portion 3*a* can be increased as compared with the structure of the FIG. 13. As a result, the number of expansion and contracting operations of the pump portion 3*a* per one rotation of the cylindrical portion 2*k* can be increased. Furthermore, since a flow speed of the air entering the developer supply container 1 through the discharge opening 4*a* increases, the loosening effect to the developer existing in the neighborhood of the discharge opening 4*a* is enhanced.

On the contrary, if the selection satisfies α'<α and β'<β, the rotational torque of the cylindrical portion 2*k* can be decreased. When a developer having a high flowability is used, for example, the expansion of the pump portion 3*a* tends to cause the air entered through the discharge opening 4*a* to blow out the developer existing in the neighborhood of the discharge opening 4*a*. As a result, there is a possibility that the developer cannot be accumulated sufficiently in the discharging portion 4*c*, and therefore, the developer discharge amount decreases. In this case, by decreasing the expanding speed of the pump portion 3*a* in accordance with this selection, the blowing-out of the developer can be suppressed, and therefore, the discharging power can be improved.

If, as shown in FIG. 17, the angle of the cam groove 2*e* is selected so as to satisfy $\alpha<\beta$, the expanding speed of the pump portion 3*a* can be increased as compared with a compressing speed. On the contrary, if the angle $\alpha>$ the angle $\beta$, the expanding speed of the pump portion 3*a* can be reduced as compared with the compressing speed.

By doing so, when the developer is in a highly packed state, for example, the operation force of the pump portion 3*a* is larger in a compression stroke of the pump portion 3*a* than in a expansion stroke thereof, with the result that the rotational torque for the cylindrical portion 2*k* tends to be higher in the compression stroke of the pump portion 3*a*. However, in this case, if the cam groove 2*e* is constructed as shown in FIG. 17, the developer loosening effect in the expansion stroke of the pump portion 3*a* can be enhanced as compared with the structure of FIG. 13. In addition, the resistance received by the engaging projection 3*c* from the cam groove 2*e* in the compression stroke of the pump portion 3*a* is small, and therefore, the increase of the rotational torque in the compression of the pump portion 3*a* can be suppressed.

As shown in FIG. 18, the cam groove 2*e* may be provided so that the engaging projection 3*c* passes the cam groove 2*g* immediately after passing the cam groove 2*h*. In such a case, immediately after the sucking operation of the pump portion 3*a*, the discharging operation starts. The stroke of operation stop in the state of the pump portion 3*a* expanding, as shown in FIG. 13 is omitted, and therefore, the pressure reduced state in the developer supply container 1 is not kept during the omitted stopping operation, and therefore, the loosening effect of the developer is decreased. However, the omission of the stopping step increases the discharged amount of the developer T, because the suction and discharging strokes are effected more during one rotation of the cylindrical portion 2*k*.

As shown in FIG. 19, the operation rest stroke (cam groove 2*i*) may be provided halfway in the discharging stroke and the suction stroke other than the most contracted the state of the pump portion 3*a* and the most expanded state of the pump portion 3*a*. By doing so, necessary volume change amount can be selected, and the pressure in the developer supply container 1 can be adjusted.

By changing the configuration of the cam groove 2*e* as shown in FIGS. 13, 15-19, the discharging power of the developer supply container 1 can be ejected, and therefore, the device of this embodiment can meet the developer amount required by the developer supplying apparatus 201 and/or the property of the used developer or the like.

As described in the foregoing, in this example, the driving force for rotating the feeding portion (helical projection) 3*c* and the driving force for reciprocating the pump portion 3*a* are received by a single drive receiving portion (gear portion 2*a*). Therefore, the structure of the drive inputting mechanism of the developer supply container can be simplified. In addition, by the single driving mechanism (driving gear 300) provided in the developer replenishing apparatus, the driving force is applied to the developer supply container, and therefore, the driving mechanism for the developer replenishing apparatus can be simplified.

With the structure of the example, the rotational force for rotating the feeding portion received from the developer replenishing apparatus is converted by the drive converting mechanism of the developer supply container, by which the pump portion can be reciprocated properly.

(Phase Detecting Portion)

The developer supply container 1 is provided with a phase detecting portion (portion-to-be-detected) 6*a* for detection of the phase of the groove, so that the rotation stops with the engaging projection 3*c* being in engagement with any one of cam groove (first operation portion) 2*g*, the cam groove (second operation portion) 2*h* and the cam groove (non-operation portion) 2*i* of the cam groove portion 2*e* constituting the drive converting portion.

In Embodiment 1, the phase detecting portion 6*a* is provided on the developer supply container 1 for the purpose of stopping the rotation at a predetermined position, more particularly, it stops in the state that the engaging projection 3*c* is in a predetermined of the cam groove.

Using the phase detecting portion 6*a*, the developer supply container 1 having the feeding portion 2*c* is stopped in the state that engaging projection 3*c* is engaged with the cam groove 2*i* (non-operation portion) of the cam groove portion 2*e*. More particularly, the phase detecting portion 6*a* transmits to the control device (CPU) 600 the phase (the engaging projection 3*c* is engaged with the cam groove 2*i*) of the developer supply container 1 at which the rotation of the feeding portion 2*c* is to be stopped. As will be described hereinafter, the main assembly side of the apparatus comprises a detecting portion 600*a* for detecting the phase detecting portion 6*a* (FIG. 20). On the basis of the detection signal of the detecting portion 600*a*, as described hereinbefore, the control device (CPU) 600 controls the operation of the driving motor 500.

FIG. 22 is a flow chart illustrating a flow of the rotation control. Referring to FIG. 22, the developer supplying step will be described.

The control device 600 instructs the rotating operation of the driving motor 500 in response to an output of the magnetometric sensor 800*c* for detecting the toner content in the developer contained in the stirring chamber.

More particularly, the magnetometric sensor 800*c* checks the toner content of the developer in the stirring chamber. When the toner content of the developer in the stirring chamber is low, the control device 600 instructs the rotation of the driving motor 500 (S201). Then, the gear portion 2*d* starts to rotate. Subsequently, when the pump portion 3*a* in the operation stop phase (the engaging projection 3*c* is engaged with the cam groove 2*i*), the phase detecting portion 6*a* instructs the control device 600 to stop the driving motor 500 (S202). On the other hand, when the pump portion 3*a* is not in the operation stop phase (the engaging projection 3*c* is not engaged with the cam groove 2*i*), the driving motor 500 continues to rotate. By the rotation drive stop of the driving motor 500, the rotation of the gear portion 2*d* stops (S203). After the series of operations (S200-S203), the magnetometric sensor 800*c* checks the toner content of the developer in the stirring chamber, again (S200). When the toner content of the developer in the stirring chamber is sufficiently high, the series of developer supplying step operations stops, and when the toner content of the developer in the stirring chamber is not sufficiently high, the operations S200-S203 are repeated.

A discharge amount of the developer per one operation (one reciprocation of the pump portion from the suction stroke to the discharging stroke) from the developer supply container is constant (5*g*), but such a supply operation does not influence the image formation using the developer replenishing apparatus side. For example, the supply amount of the developer required by the developer receiving side when the toner content of the developer replenishing apparatus side (receiving side) is not enough (FIG. 22, S200, NO) may be the constant amount (5*g*) or may be less than the constant amount (5*g*). When the supply amount required by the receiving side is less than the constant amount, the constant amount of the developer is supplied from the developer supply container, with the result that the amount of the supplied developer is larger than the required amount. However, the image formation using the developer in the receiving side is not influenced by such a developer supply from the developer supply container.

FIG. 3 is an enlarged sectional view illustrating a developer supply container and the developer replenishing apparatus. Part (a) of FIG. 21 is a partial enlarged view illustrating a phase detecting portion position during the rotation of a driving motor, (b) is a partial enlarged view of the phase detecting portion position when the driving motor is at rest, and (c) is a partial enlarged view of an example of the phase detecting portion position when the driving motor is at rest. Referring to parts (a) and (b), the position of the phase detecting portion 6*a* during rotation of the driving motor 500 and at the time of rotation stop thereof will be described.

In this example, the detecting portion 600*a* for detecting phase detecting portion 6*a* of the developer supply container 1 uses an optical photo-sensor. When the rotating developer supply container 1 is stopped, the phase detecting portion 6*a* which rotates integrally with the developer supply container 1 raise a hiding portion 600*b* to cover the detecting portion 600*a*, in response to which a signal for stopping the rotation of the driving motor 500 is outputted from the control device 600. In response to the output of the signal, the rotation of the driving motor 500 stops. In this embodiment, the time from the output of the signal to the stop of the driving motor 500 is substantially 0 sec, that is, the driving motor 500 stops substantially simultaneously with the output of the signal. On the other hand, when the phase detecting portion 6*a* does not cover the detecting portion 600*a*, the driving motor 500 continues to rotate. Part (a) of FIG. 21 shows the state in which the phase detecting portion 6*a* raises the hiding portion 600*b* to cover the detecting portion 600*a* in the operation rest stroke of the pump portion 3*a*. Part (b) of FIG. 21 shows the state in which the phase detecting portion 6*a* does not raise the hiding portion 600*b*, and therefore, the detecting portion 600*a* is not covered by the hiding portion 600*b* in the discharging stroke or suction stroke (not in the operation rest stroke) of the pump portion 3*a*. Thus, the phase detecting portion 6*a* instructs the control device 600 to stop the rotation of the driving motor 500 by raising the hiding portion 600*b* to cover the rise detecting portion 600*a*.

In this manner, when the pump portion 3*a* starts the rotation, the supplying operation always starts at the same expansion and contraction state of the pump portion, and therefore, the variation of the supplying state at the supply start can be reduced.

The effects of the structure will be compared with the case in which the stop position of the pump portion 3*a* is not particularly determined.

The case in which the stop position is always constant includes the case in which the stop occurs in a halfway of the suction stroke, the case in which the stop occurs in a halfway of the discharging stroke and the case in which the stop occurs in a halfway of the operation rest stroke. The otherwise case is the case in which no control is effected as to the stop position in the suction stroke, the discharging stroke and in the operation rest stroke, that is, random stop.

When the rotation stop occurs in the halfway of the suction stroke, the suction stroke, the pump portion 3*a* effects the discharging stroke, the operation rest stroke, the suction stroke in the order named during one half rotation of the container, and the developer is discharged through the discharge opening with such a rotation. Similarly, when the rotation stop occurs in the halfway of the discharging stroke, the pump portion 3*a* effects of the discharging stroke, the operation rest stroke, the suction stroke and the discharging stroke in the order named during one half rotation of the container, and the developer is discharged through the discharge opening with such a rotation. When the rotational stop occurs in the halfway of the operation rest stroke, the pump portion 3*a* effects of the operation rest stroke, the suction stroke, the discharging stroke and the operation rest stroke in the order named, and the developer is discharged through the discharge opening with such a rotation.

It is assumed that in the case in which the stop position is constant, the stop of the container occurs at each one half rotation of the container (each one reciprocation of the pump portion) in each of the strokes. That is, in the one half rotation of the container from a suction stroke to the next suction stroke, the rotation stops halfway of the suction stroke, and in the one half rotation of the container from a discharging stroke to the next discharging stroke, the rotation stops halfway of the discharging stroke, and in the one half rotation of the container from an operation rest stroke to the next halfway of the operation stroke, the rotation stops halfway of the operation rest stroke. On the other hand, in the case in which the stop position is random, the stop position of the container is randomly halfway of one of the strokes.

In the case of the random stop position of the container without control, irrespective of the suction stroke, the discharging stroke or the operation stop stroke, the discharge amount of the developer is not stable. This is because the discharge amount of the developer in the one half rotation of the container is different between the case in which the stop occurs in the suction stroke, the case in which the stop occurs in the discharging stroke, and the case in which the stop occurs in the operation rest stroke. On the other hand, when the stop occurs halfway of the stroke, in the discharge amount of the developer is stable as compared with the case of the random stop position.

From the foregoing analysis, the variation of the developer discharge amount can be suppressed by stopping the rotation of the feeding portion 2*c* during one of the discharging stroke, the suction stroke and the operation rest stroke.

It is further preferred that the drive receiving portion is stopped during the suction stroke or the operation rest stroke, since then the variation of the discharging property of the developer can be suppressed. In the case that the apparatus is kept unoperated for a long-term after developer supplying operation, for example, it is preferable that the pump portion starts with the sucking operation phase, which will be effective to loosen the developer, and then the discharging stroke is carried out, from the stand point of preventing the plugging of the discharge opening (opening). Therefore, the operation start of the pump portion is preferably the sucking operation from the standpoint of the prevention of the plugging of the discharge opening with the developer, and when the stop occurs halfway of the discharging stroke, the subsequent operation start is the discharging stroke, and therefore, it is not preferable. In the case that the drive receiving portion is stopped in the suction stroke, the driving motor 500 is stopped on the basis of the detection by the phase detecting portion 6*a*, so that the pump portion stops at the predetermined position.

Further preferably, the rotation of the drive receiving portion is stopped during the operation rest stroke, since then the variation of the developer discharging property can be further suppressed, and therefore, the discharging property is further stabilized. This is because if the operation stops in the suction stroke in which the internal pressure of the container is decreasing, the inside of the container in the pressure-reduced state, but the pressure gradually approaches to the ambient pressure. If the subsequent start of the operation is carried out with the halfway of the suction stroke, the reduction of the internal pressure of the container is less than the maximum with the possible result of less loosening effect to the developer, and therefore, unstable developer discharge amount. This is particularly so, in the case of the long-term rest. In order to always assure the maximum loosening effect of the suction stroke, it is preferable that the rotation of the drive receiving portion is stopped during the operation rest stroke after the discharging stroke and before the start of the suction stroke, since then the developer loosening effect is maximum. In other words, the rotation is stopped most of preferably in the operation rest stroke in the period in which the volume of the pump portion changes from the decrease to the increase.

As described in the foregoing, by stopping the rotation of the drive receiving portion in one of the strokes of the discharging stroke, the suction stroke and the operation rest stroke, the variation of the developer discharging property is suppressed as compared with the case in which the stop position is not determined at a constant position, and the developer discharging property is stabilized. It is further preferred that the drive receiving portion is stopped during the suction stroke or the operation rest stroke, since then the variation of the discharging property of the developer can be suppressed.

Further preferably, the rotation is stopped in the operation rest stroke in the period in which the volume of the pump portion changes from the decrease stroke to the increase stroke, in which case the developer discharge amount is not that in the case in which the stop occurs halfway of the suction stroke or discharging stroke. Then, the variation of the developer discharging property can be further suppressed, and therefore, the discharge amount of the developer is further stabilized. Particularly by limiting the rotation stop position to the operation rest stroke, the developer discharge amount is further stabilized because neither the sucking operation effective to loosen the developer nor the discharging operation effective to discharge the developer is carried out.

In this example, the instructions to stop the rotation of the driving motor 500 is produced to the control device 600 upon the detecting portion 600*a* being covered, but it is a possible alternative that when the detecting portion 600*a* is covered, the driving motor 500, the news to rotate, and when the detecting portion 600*a* is uncovered, the rotation of the driving motor 500 is stopped. In such a case, the cam groove 2*e* has to be provided such that the pump portion 3*a* is not in the operation rest stroke during the rotation, and the pump portion 3*a* is in the operation rest stroke at the rotation stop. In addition, the phase detecting portion 6*a* has to be provided such that the detecting portion 600*a* is cover during the rotation, and the detecting portion 600*a* is uncovered and the stop.

In addition in this embodiment, as shown in parts (a) and (b), the hiding portion 600*b* is used to cover the detecting portion 600*a*, but the phase detecting portion 6*ae* per se may be used to cover the detecting portion 600*a* without employing the hiding portion 600*b*. In this embodiment, the detecting portion 600*a* is a photo-sensor, but it may be a commercially available micro-switch or the like.

As described in the foregoing, in this example, the phase detecting portion 6*a* for instructing the rotation stop of the driving motor 500 in the state that the pump portion 3*a* is in the operation rest stroke is provided on the developer supply container 1. In addition, the phase detecting portion 6*a* in this example has a projection or recess in which she rotates in interrelation with the cylindrical portion 2*k* of the developer supply container 1. By these provisions, the rotation of the developer supply container 1 having the feeding portion 2*c* is stopped when the pump portion 3*a* is in the operation rest stroke. Therefore, it can be suppressed that the difference in the volume change amount by the reciprocation of the pump portion, and the instability of the developer discharging property through the discharge opening of the developer supply container into the developer supplying apparatus can be suppressed. In other words, according to this example, the volume change amount by one reciprocation is constant, so that the developer discharging property through the discharge opening is enhanced.

As shown in FIG. 20, in this example, the phase detecting portion 6*a* is provided in a position downstream of the cam groove 2*e* which is the drive converting portion with respect to the inserting direction of the developer supply container 1 (X direction in part (a) of FIG. 8). By this, the volume of the developer supply container is assured. In consideration of the interference with a gear in the main assembly side during the container mounting operation, it is desired not to project out beyond the outer shape of the container body portion or the drive receiving portion, and therefore, the position downstream of the cam groove 2*e* with respect to the container inserting direction is preferable. Then, the cam groove 2*e* is disposed in the downstream most position with respect to the container dismounting direction, and therefore, the reciprocation member 3*b* can be downsized, so that the entire container can be downsized.

This embodiment, a plurality of cyclic operations of the pump portion 3*a* are carried out in the period of one full rotation of the cylindrical portion 2*k* (feeding portion 2*c*), and as shown in part (a) and part (c) of FIG. 21, the same number (the number of pumpings in one full rotation of the feeding portion 2*c*, the number of reciprocations) of the phase detecting portions 6*a* (portions-to-be-detected) are provided. By doing so, the rotation stop can be controlled for each one cycle including the suction stroke, the discharging stroke and the operation stop stroke, and therefore, the supplied amount of the developer upon the developer supply is made more constant.

The developer supply container is not completely hermetical, and therefore, the peak pressure reached when the pump portion is reciprocated is different depending on the reciprocation speed, even when the volume change of the pump portion is the same. For this reason, it is preferable that the speed of the operation of the pump portion is controlled so as to be constant to a certain extent. In view of this, the phase detecting portion 6*a* as the portion-to-be-detected is such that the pump portion is stopped by the non-operation portion so that rotational speed reaches the desired speed after the start of the rotation before the pump portion reaches the first operation portion (discharging stroke). With such a structure, the feeding portion already reaches the desired speed upon the discharging stroke of the pump portion which is the developer supplying stroke. Therefore, the possibility can be avoided that the pump portion reaches the operation portion with the speed less than the desired speed with the result of insufficient suction stroke and therefore unstable developer supply. That is, with the above-described structure, the developer supply amount is further stabilized, and the discharging property is improved.

Embodiment 2

Referring to FIGS. 23 and 24, a structure of Embodiment 2 will be described. Part (a) of FIG. 23 is a partial view in a state in which the pump portion according to Embodiment 2 is expanded to the maximum usable limit, and (b) is a partial view in a state in which the pump portion is contracted to the maximum usable limit. Part (a) of FIG. 24 is a partial view which is similar to part (a) of FIG. 23 and is deprived of a protecting member 3*e*, (b) is a partial view which is similar to part (b) of FIG. 23 and is deprived of the protecting member 3*e*.

In the description of this embodiment, the same reference numerals as in Embodiment 1 are assigned to the elements having the corresponding functions in this embodiment, and the detailed description thereof is omitted for simplicity.

In Embodiment 1, the phase detecting portion 6*a* as the portion-to-be-detected is provided on the circumferential surface of the rotatable developer supply container 1 to rotate in interrelation with the cylindrical portion 2*k* of the developer supply container 1. In this embodiment, a reciprocation instructing portion 6*b* as the portion-to-be-detected is provided on the reciprocation member 3*b* to reciprocate in interrelation with the reciprocation member 3*b*. The structures of this embodiment are substantially the same as those of Embodiment 1 in the other respects.

In this embodiment, the reciprocation member 3*b* is integral with the reciprocation instructing portion 6*b*, and therefore, the reciprocation member 3*b* functions as the reciprocation instructing portion 6*b*. As shown in part (a) of FIG. 23, in the most expanded state of the pump portion 3*a*, the reciprocation instructing portion 6*b* is behind the protecting member 3*e* so that it is not seen from the outside of the developer supply container 1. As shown in part (b) of FIG. 23, in the most contracted the state of the pump portion 3*a*, the reciprocation instructing portion 6*b* is exposed so that it is seen from the outside of the developer supply container 1.

As shown in the parts (a) and (b) of FIG. 23, the reciprocation instructing portion 6*b* is exposed in interrelation with the reciprocation of the reciprocation member 3*b*, by which the detecting portion 600*a* is covered to instruct the control device 600 to stop the driving motor 500. The reciprocation instructing portion 6*b* produces the stop instructions when the pump portion 3*a* is in the operation rest stroke (the state in which the engaging projection 3*c* is engaged with the cam groove 2*i*).

The cam groove 2*e* shown in FIGS. 23 and 24 has the structure as shown in FIG. 18, but this is not inevitable and the rotation stop may be instructed using the cam groove 2*i* shown in FIG. 13, 15, 16, 17 or 19. In addition, the present invention is not limited to the structure in which the rotation stop is instructed when the reciprocation instructing portion 6*b* is exposed on the surface of the developer supply container 1, but it may be exposed always. More particularly, in this example, the reciprocation instructions portion 6*b* is disposed at a position closest to the gear portion 2*d*, but the reciprocation instructions portion 6*b* may be provided at any position on the reciprocation member 3*b* as long as the reciprocation instructions portion 6*b* is movable between the detection position and non-detection position which is a position retracted from the detection position, in interrelation with the operation of the reciprocation member 3*b*.

As described in the foregoing, also in this embodiment, similarly to Embodiments 1, the control device 600 may be instructed to stop the driving motor 500 at the time when the pump portion 3*a* is in the operation rest stroke. Therefore, the same effects as with Embodiment 1 are provided. In this example, the detecting portion 600*a* for discriminating that the pump portion 3*a* is in the operation rest stroke can be provided at the position within the range of the reciprocation member 3*b* in the rotational axis direction of the cylindrical portion 2*k*, and therefore, the latitude in design is improved.

Embodiment 3

In the above-described embodiment, the cam groove 2*e* which is the drive converting portion is provided with a cam groove portion 2*i* which is a non-operation portion not converting the force to the force operating the pump portion 3*a*, but this is not inevitable to the present invention. The drive converting portion may not be provided with the non-operation portion. More particularly, the cam groove 2*e* which is the drive converting portion may include a cam groove 2 *g* which is the first operation portion for converting the force to the force decreasing the volume of the pump portion 3*a* in the cam groove 2*h* which is a second operation portion for converting the force to the force increasing the volume of the pump portion 3*a*.

In such a case, the phase detecting portion for the rotation stop is provided at a position of the cam groove 2 *g* (first operation portion) or the cam groove 2*h* (second operation portion). More particularly, the phase detecting portion for stopping the rotation of the driving motor 500 when the pump portion 3*a* is in the discharging stroke or the suction stroke is provided.

Preferably, the phase detecting portion for the rotation stop is provided such that the rotation is stopped by the cam groove 2*h* which is the second operation portion of the cam groove 2*e* which is the drive converting portion. That is, the phase detecting portion stops the rotation of the driving motor 500 when the pump portion 3*a* is in the suction stroke.

Also, with such a structure, similarly to the embodiments described hereinbefore, the difference in the volume change amount by the reciprocation of the pump portion can be suppressed, and the instability of the developer discharging property through the discharge opening can be suppressed.

Other Embodiments

In the foregoing embodiments, as shown in FIG. 19 and so on, the phase detecting portion 6*a* which is the phase detecting portion is projected out from the circumferential surface of the developer supply container 1 (cylindrical portion 2*k*), but the present invention is not limited to such a structure. As shown in FIG. 25, the phase detecting portion 6*a* which is the phase detecting portion may be a recess from the circumferential surface Of the developer supply container 1 (cylindrical portion 2*k*). Part (a) of FIG. 25 is an enlarged sectional view of the developer supply container and the developer supplying apparatus, (b) is a partial enlarged view of the phase detecting portion position during the rotation of the driving motor, and (c) is a partial enlarged view of the phase detecting portion position when the driving motor is at rest. With such a structure, the same effects as with the foregoing embodiments using a phase detecting portion in the form of a projection can be provided.

In the foregoing embodiments, the printer as the image forming apparatus is taken, but the present invention is not limited to a printer. For example, it may be a copying machine, a facsimile machine or another image forming apparatus, or a multifunction machine having functions of them in combination, or the like. The similar effects can be provided when the present invention is applied to a developer supply container or a developer supplying system used with such an image forming apparatus.

INDUSTRIAL APPLICABILITY

According to the present invention, the occurrence of the tendency of the difference in the amount of the volume change caused by the reciprocation of the pump portion which may result from different stop positions of the pump portion can be reduced.

The invention claimed is:

1. A developer supply container detachably mountable to a developer supplying apparatus, said developer supply container comprising:

a developer accommodating portion configured to accommodate developer;

a rotatable drive receiving portion configured to receive a rotational driving force;

a feeding portion configured to feed the developer in said developer accommodating portion by rotation of said drive receiving portion;

a developer discharging chamber provided with a discharge opening configured to discharge the developer fed by said feeding portion;

a pump portion provided to act at least on said developer discharging chamber and having a volume changeable with expansion and contraction with reciprocation;

an operating portion configured to operate said pump portion; and a portion-to-be-detected to be detected by a detecting portion provided in the developer supplying apparatus to stop said pump portion in a predetermined expansion and contraction state of said pump portion when operation of said pump portion is stopped.

2. A developer supply container according to claim 1, further comprising a drive converting portion configured to convert the rotational force received by said drive receiving portion into a force for opening said pump portion wherein a rotation of said feeding portion is stopped at such a position that the force for operating said pump portion is converted to increase the volume of said pump portion or the force is not converted to operate said pump portion.

3. A developer supply container according to claim 2, wherein the rotation of said feeding portion is stopped at such a position that the force is not converted to operate said pump portion.

4. A developer supply container according to claim 3, wherein said pump portion is stopped at such a position that the force is not covered to operate said pump portion, before and after which the volume change of said pump portion changes from decreasing to increasing.

5. A developer supplying container according to claim 4, wherein said pump portion is stopped at such a position that the rotational speed becomes a predetermined speed after start of the rotation and before a state is reached in which the volume of said pump portion decreases.

6. A developer supply container according to claim 1, further comprising a drive converting portion configured to convert the rotational force received by said drive receiving portion into a force for operating said pump portion, wherein said portion-to-be-detected is moved in interrelation with the rotation of said drive receiving portion.

7. A developer supply container according to claim 6, wherein said portion-to-be-detected is provided by projection and recess on a circumferential surface.

8. A developer supply container according to claim 6, wherein a number of such portions-to-be-detected are provided, the number being the same as a number of reciprocations of said pump portion in one full rotation of said feeding portion.

9. A developer supply container according to claim 1, further comprising a drive converting portion configured to convert the rotational force received by said drive receiving portion into a force for operating said pump portion, wherein said portion-to-be-detected is disposed at a position downstream of said drive converting portion with respect to an inserting direction of said developer supply container into the developer supplying apparatus.

10. A developer supply container according to claim 1, wherein said portion-to-be-detected is interrelated with a reciprocation of said pump portion.

11. A developer supply container according to claim 10, wherein said portion-to-be-detected is exposed on a surface of said developer supply container in interrelation with the reciprocation of said pump portion.

12. A developer supply container detachably mountable to a developer supplying apparatus, said developer supply container comprising:

a developer accommodating portion configured to accommodate developer;

a rotatable drive receiving portion configured to receive a rotational driving force;

a feeding portion configured to feed the developer in said developer accommodating portion by rotation of said drive receiving portion;

a developer discharging chamber provided with a discharge opening configured to discharge the developer fed by said feeding portion;

a pump portion provided to act at least on said developer discharging chamber and having a volume changeable with expansion and contraction with reciprocation;

an operating portion configured to operate said pump portion, said operating portion including a first operation portion for operating said pump portion to discharge the air through said discharge opening and a second operation portion for operating said pump portion to suck the air through said discharge opening; and a portion-to-be-detected to be detected by a detecting portion provided in developer supplying apparatus so as to prevent, when an operation of said pump portion is to be stopped, said pump portion from stopping when said first operation portion operates said pump portion.

13. A developer supply container according to claim 12, further comprising a drive converting portion configured to convert the rotational force received by said drive receiving portion into a force for operating said pump portion, wherein said portion-to-be-detected is moved in interrelation with the rotation of said drive receiving portion.

14. A developer supply container according to claim 13, wherein said portion-to-be-detected is provided by projection and recess on a circumferential surface.

15. A developer supply container according to claim 13, wherein a number of such portions-to-be-detected are provided, the number being the same as a number of reciprocations of said pump portion in one full rotation of said feeding portion.

16. A developer supply container according to claim 12, further comprising a drive converting portion configured to convert the rotational force received by said drive receiving portion into a force for operating said pump portion, wherein said portion-to-be-detected is disposed at a position downstream of said drive converting portion with respect to an inserting direction of said developer supply container into the developer supplying apparatus.

17. A developer supply container according to claim 12, wherein said portion-to-be-detected is interrelated with a reciprocation of said pump portion.

18. A developer supply container according to claim 17, wherein said portion-to-be-detected is exposed on a surface of said developer supply container in interrelation with the reciprocation of said pump portion.

19. A developer supplying system including a developer supplying apparatus and a developer supply container detachably mountable to said developer supplying apparatus, wherein said developer supply container includes:

a developer accommodating portion configured to accommodate developer;

a rotatable drive receiving portion configured to receive a rotational driving force;

a feeding portion configured to feed the developer in said developer accommodating portion by rotation of said drive receiving portion;

a developer discharging chamber provided with a discharge opening configured to discharge the developer fed by said feeding portion;

a pump portion provided to act at least on said developer discharging chamber and having a volume changeable with expansion and contraction with reciprocation;

an operating portion configured to operate said pump portion; and a portion-to-be-detected to be detected by a detecting portion provided in the developer supplying apparatus to stop said pump portion in a predetermined expansion and contraction state of said pump portion when operation of said pump portion is stopped, and wherein said developer supplying apparatus includes:

a mounting portion configured to dismountably mount said developer supply container;

a developer receiving portion configured to receive the developer through said discharge opening;

a driving portion configured to apply said rotational driving force to said drive receiving portion;

said detecting portion configured to detect said portion-to-be-detected; and a controller configured to control the operation of said driving portion on the basis of a detection signal of said detecting portion.

20. A developer supplying system according to claim 19, further comprising a drive converting portion configured to convert the rotational force received by said drive receiving portion into a force for operating said pump portion, wherein a rotation of said feeding portion is stopped at such a position that the force for operating said pump portion is converted to increase the volume of said pump portion or the force is not converted to operate said pump portion.

21. A developer supplying system according to claim 20, wherein the rotation of said feeding portion is stopped at such a position that the force is not converted to operate said pump position.

22. A developer supplying system according to claim 21, wherein said pump portion is stopped at such a position that the force is not coverted to operate said pump portion before and after which the volume change of said pump portion changes from decreasing to increasing.

23. A developer supplying system according to claim 22, said pump portion is stopped at such position that the rotational speed becomes a predetermined speed after start of the rotation and before a state is reached in which the volume of said pump portion decreases.

24. A developer supplying system according to claim 19, further comprising a drive converting portion configured to convert the rotational force received by said drive receiving portion into a force for operating said pump portion, wherein said portion-to-be-detected is moved in interrelation with the rotation of said drive receiving portion.

25. A developer supplying system according to claim 24, wherein said portion-to-be-detected is provided by projection and recess on a circumferential surface.

26. A developer supplying system according to claim 24, wherein a number of such portions-to-be-detected are provided, the number being the same as a number of reciprocations of said pump portion in one full rotation of said feeding portion.

27. A developer supplying system according to claim 19, further comprising a drive converting portion configured to convert the rotational force received by said drive receiving portion into a force for operating said pump portion, wherein said portion-to-be-detected is disposed at a position downstream of said drive converting portion with respect to an inserting direction of said developer supply container into said developer supplying apparatus.

28. A developer supplying system according to claim 19, wherein said portion-to-be-detected is interrelated with a reciprocation of said pump portion.

29. A developer supplying system according to claim 28, wherein said portion-to-be-detected is exposed on a surface of said developer supply container in interrelation with the reciprocation of said pump portion.

30. A developer supplying system including a developer supplying apparatus and a developer supply container detachably mountable to said developer supplying apparatus, wherein said developer supply container includes:

a developer accommodating portion configured to accommodate developer;

a rotatable drive receiving portion configured to receive a rotational driving force;

a feeding portion configured to feed the developer in said developer accommodating portion by rotation of said drive receiving portion;

a developer discharging chamber provided with a discharge opening configured to discharge the developer fed by said feeding portion;

a pump portion provided to act at least on said developer discharging chamber and having a volume changeable with expansion and contraction with reciprocation;

an operating portion configured to operate said pump portion, said operating portion including a first operation portion for operating said pump portion to discharge the air through said discharge opening and a second operation portion for operating said pump portion to suck the air through said discharge opening; and a portion-to-be-detected to be detected by a detecting portion provided in developer supplying apparatus so as to prevent, when an operation of said pump portion is to be stopped, said pump portion from stopping when said first operation portion operates said pump portion, and wherein said developer supplying apparatus includes:

a mounting portion configured to dismountably mount said developer supply container;

a developer receiving portion configured to receive the developer through said discharge opening;

a driving portion configured to apply said rotational driving force to said drive receiving portion;

said detecting portion configured to detect said portion-to-be-detected; and a controller configured to control the operation of said driving portion on the basis of a detection signal of said detecting portion.

31. A developer supplying system according to claim 30, further comprising a drive converting portion configured to convert the rotational force received by said drive receiving portion into a force for operating said pump portion, wherein said portion-to-be-detected is moved in interrelation with the rotation of said drive receiving portion.

32. A developer supplying system according to claim 31, wherein said portion-to-be-detected is provided by projection and recess on a circumferential surface.

33. A developer supplying system according to claim 31, wherein a number of such portions-to-be-detected are provided, the number being the same as a number of reciprocations of said pump portion in one full rotation of said feeding portion.

34. A developer supplying system according to claim 30, further comprising a drive converting portion configured to convert the rotational force received by said drive receiving portion into a force for operating said pump portion, wherein said portion-to-be-detected is disposed at a position downstream of said drive converting portion with respect to an inserting direction of said developer supply container into said developer supplying apparatus.

35. A developer supplying system according to claim 30, wherein said portion-to-be-detected is interrelated with a reciprocation of said pump portion.

36. A developer supplying system according to claim 35, wherein said portion-to-be-detected is exposed on a surface of said developer supply container in interrelation with the reciprocation of said pump portion.

* * * * *